US011198231B2

(12) United States Patent
Motz

(10) Patent No.: US 11,198,231 B2
(45) Date of Patent: Dec. 14, 2021

(54) PROCESS AND SYSTEM FOR MAKING AN EROSION CONTROL MAT

(71) Applicant: Motz Enterprises, Inc., Cincinnati, OH (US)

(72) Inventor: Matthew J. Motz, Cincinnati, OH (US)

(73) Assignee: MOTZ ENTERPRISES, INC., Cincinnati, OH (US)

( * ) Notice: Subject to any disclaimer, the term of this patent is extended or adjusted under 35 U.S.C. 154(b) by 184 days.

(21) Appl. No.: 16/295,784

(22) Filed: Mar. 7, 2019

(65) Prior Publication Data

US 2019/0202084 A1 Jul. 4, 2019

Related U.S. Application Data

(63) Continuation-in-part of application No. 15/048,539, filed on Feb. 19, 2016, now Pat. No. 10,239,240.

(51) Int. Cl.
*B28B 5/10* (2006.01)
*B28B 23/00* (2006.01)
(Continued)

(52) U.S. Cl.
CPC ..... *B28B 5/10* (2013.01); *B28B 19/0092* (2013.01); *B28B 23/0012* (2013.01); *D04H 11/00* (2013.01); *E02B 3/123* (2013.01); *E02B 3/126* (2013.01); *D10B 2321/022* (2013.01); *D10B 2505/204* (2013.01)

(58) Field of Classification Search
CPC ..... B28B 5/10; B28B 13/02; B28B 13/029; B28B 23/0012; E02B 3/123; E02D 17/202
See application file for complete search history.

(56) References Cited

U.S. PATENT DOCUMENTS 1,451,229 A 4/1923 Loudenslager
3,332,187 A 7/1967 Arcari
(Continued)

FOREIGN PATENT DOCUMENTS

AU 2015100623 6/2015
EP 0123737 11/1984
(Continued)

OTHER PUBLICATIONS

U.S. Final Office Action; U.S. Patent and Trademark Office; U.S. Appl. No. 16/440,094, 14 pages (dated Jan. 14, 2021).
(Continued)

*Primary Examiner* — James P Mackey
(74) *Attorney, Agent, or Firm* — Thompson Hine LLP

(57) ABSTRACT

A process for making an erosion control mat includes rotating a cylindrical drum having a plurality of mold cavities; depositing a paste into the mold cavities; selecting the sheet of mesh material to have sufficient tensile strength to join the blocks of hardened paste together without tearing or separating from the blocks of hardened paste, and to have sufficient density to retain the paste within the mold cavities as the drum rotates; covering an outer surface of the cylindrical drum and outer surfaces of the paste with the sheet of mesh material; continuing to rotate the cylindrical drum as the paste hardens into dimensionally stable blocks, and holding the sheet against the outer surface such that the sheet retains the paste within the mold cavities and the sheet becomes embedded in the paste; and separating the dimensionally stable blocks from the mold cavities.

27 Claims, 17 Drawing Sheets

(51) Int. Cl.

| | |
|---|---|
| ***B28B 19/00*** | (2006.01) |
| ***D04H 11/00*** | (2006.01) |
| ***E02B 3/12*** | (2006.01) |

(56) References Cited

U.S. PATENT DOCUMENTS

| | | | |
|---|---|---|---|
| 3,477,108 | A | 11/1969 | Stokes |
| 3,597,928 | A | 8/1971 | Pilaar |
| 3,720,493 | A | 3/1973 | Borcoman et al. |
| 3,970,204 | A | 7/1976 | Lutz |
| 3,981,669 | A | 9/1976 | Gambill et al. |
| 4,311,273 | A | 1/1982 | Marsh |
| 4,475,648 | A | 10/1984 | Weeks |
| 4,859,516 | A | 8/1989 | Yamanaka et al. |
| 5,039,250 | A | 8/1991 | Janz |
| 5,048,640 | A | 9/1991 | McConville et al. |
| 5,064,584 | A | 11/1991 | Jefferies |
| 5,082,397 | A | 1/1992 | Raviv |
| 5,443,329 | A | 8/1995 | de Geeter |
| 5,501,753 | A | 3/1996 | Stark |
| 5,554,393 | A | 9/1996 | Uchida et al. |
| 5,911,539 | A | 6/1999 | Egan |
| 5,935,613 | A | 8/1999 | Benham et al. |
| 6,095,320 | A | 8/2000 | DeMong et al. |
| 6,517,294 | B2 | 2/2003 | Vreeland |
| 6,793,858 | B2 | 9/2004 | Motz |
| 6,811,802 | B2 | 11/2004 | van Esbroeck et al. |
| 6,945,739 | B1 | 9/2005 | Putnam |
| 7,634,877 | B2 | 12/2009 | Wiercinski |
| 10,161,094 | B2 | 12/2018 | Motz |
| 2001/0053310 | A1 | 12/2001 | Brown |
| 2002/0180076 | A1 | 12/2002 | Motz |
| 2011/0042844 | A1 | 2/2011 | Brown et al. |
| 2013/0101354 | A1 | 4/2013 | Lignier |

FOREIGN PATENT DOCUMENTS

| | | |
|---|---|---|
| EP | 0192861 A1 | 9/1986 |
| FR | 2261873 | 9/1975 |
| JP | 2-308061 | 12/1990 |
| KR | 20050019161 | 3/2005 |
| WO | 2011/134476 | 11/2011 |

OTHER PUBLICATIONS

PCT, International Search Report and Written Opinion, International Application No. PCT/US2017/018122, 12 pages (dated Jun. 19, 2017).
Webpage featuring "Recyclex® TRM and Recyclex® TRM-V," by American Excelsior Company, http://americanexcelsior.com/product/?sub=15 (retrieved from the internet on Aug. 25, 2015).
U.S. Office Action, U.S. Appl. No. 15/048,539 (dated Nov. 2, 2017).
U.S. Office Action, U.S. Appl. No. 15/048,539 (dated Jun. 26, 2018).
U.S. Notice of Allowance, U.S. Appl. No. 15/048,539 (dated Nov. 15, 2018).
Product Overview featuring "High Performance Geosynthetics", by Enka® Solutions (Aug. 2016).
European Patent Office, European Search Report and European Search Opinion, European Patent Application No. 20157246.8, 11 pages (dated Jul. 17, 2020).
CA, Office Action; Canadian Intellectual Property Office; Patent Application Serial No. 3,014,926, 4 pages (dated Oct. 9, 2020).
Australian Patent Office, Examination Report No. 1 issued for Australian Patent Application No. 2019204830, 5 pages (dated Aug. 7, 2020).
EP, Search Report, European Application No. 17753813.9, 7 pages (dated Aug. 26, 2019).
PCT, International Search Report and Written Opinion, International Application No. PCT/US2017/023710, 13 pages (dated Jun. 19, 2017).
EP, Search Report, European Application No. 17771110.8, 7 pages (dated Aug. 29, 2019).
U.S. Notice of Allowance, U.S. Appl. No. 15/467,516 (dated Nov. 5, 2018).
U.S. Office Action, U.S. Appl. No. 15/467,516 (dated Sep. 13, 2018).
U.S. Advisory Action, U.S. Appl. No. 15/467,516 (dated Sep. 4, 2018).
U.S. Office Action, U.S. Appl. No. 15/467,516 (dated May 11, 2018).
U.S. Office Action, U.S. Appl. No. 15/467,516 (dated Jan. 12, 2018).
AU, Examination Report No. 1, Australian Application No. 2017238225 (dated Mar. 5, 2019).
CA, Office Action, Canadian Application No. 3,018,841 (dated Mar. 29, 2019).
AU, Notice of Acceptance, Australian Application No. 2017238225 (dated Jun. 24, 2019).
AU, Notice of Acceptance, Australian Application No. 2017257882 (dated Sep. 13, 2019).
CA, Office Action, Canadian Patent Application No. 3,018,841 (dated Oct. 18, 2019).
U.S. Office Action, U.S. Appl. No. 16/277,540 (dated Jan. 9, 2020).
CA, Notice of Allowance, Canadian Patent Application No. 3,014,296 (dated Jul. 8, 2019).
CA, Office Action, Canadian Patent Application No. 3,014,926 (dated Mar. 31, 2020).
U.S. Notice of Allowance, U.S. Appl. No. 16/277,540 (dated May 28, 2020).
Product Overview featuring "Fornit® 30/30", by Huesker Engineering with Geosynthetics, 1 page (at least as early as Apr. 17, 2018).
U.S. Patent and Trademark Office, Non-Final Office Action, U.S. Appl. No. 16/530,450, 8 pages, dated Oct. 6, 2021.

PROCESS AND SYSTEM FOR MAKING AN EROSION CONTROL MAT

TECHNICAL FIELD

The present disclosure relates to processes and systems for forming flexible erosion prevention mats, and more particularly, to processes and systems for forming continuous erosion prevention mats.

BACKGROUND

Erosion is a natural process in which meteorological elements such as rain, wind, and snow remove soil, rock, and dissolved material from one location on the Earth's crust and transport it to another location. While such erosion is a natural process, certain localized human activity increases the rate of erosion to many times that at which erosion occurs naturally. Land surfaces adjacent man-made structures such as canals, roads and other paved surfaces, reservoirs and other static bodies of water, and artificially created drainage channels and other waterways are particularly susceptible to erosion because naturally occurring indigenous vegetation is removed in order to form the structures.

Erosion can be mitigated in these areas by remediating the land surface adjacent the canal, road, reservoir, pond, or channel by planting vegetation to replace the vegetation that was stripped away during construction. However, there is a time interval between the planting of the replacement vegetation and the point at which the replacement vegetation is sufficiently rooted and developed to prevent surface soil erosion during which further erosion may occur.

Efforts have been made to retain the surface soil in place in these areas until such time as vegetation can mature to the point where the root structure of the vegetation retains the soil in place. An example of such material is the flexible mat structure disclosed in U.S. Pat. No. 6,793,858 titled "Method and Apparatus for Forming a Flexible Mat Defined by Interconnected Concrete Panels," the entire contents of which are incorporated herein by reference. That patent discloses a flexible mat structure in the form of spaced, interconnected concrete panels or blocks held together by an open mesh of a polymeric material.

The flexible mat structure may be made by depositing concrete in the block-shaped mold cavities formed in the surface of a rotating drum and embedding in the concrete material the open mesh structure. While the flexible mat structure made by that method is cost competitive and has demonstrated effectiveness, there is a need to introduce additional efficiencies and variations in the structure and process of manufacture of such flexible mat structures.

SUMMARY

The present disclosure is a process for forming an erosion control mat that possesses advantages of cost effectiveness and simplicity. The process and manufacturing system are less complex than many comparable processes and manufacturing systems and utilize a sheet that consists of or includes flexible, mesh material that is at least partially embedded in and interconnects blocks of hardened paste. The sheet is selected to provide sufficient tensile strength to hold the blocks together without additional connecting structure.

In some embodiments, the sheet includes a three-dimensional mat made of interconnected filaments in a mesh and a flat, two-dimensional base, which may be a woven or nonwoven geotextile. The mesh mat may be attached or bonded to project upwardly from one side of the base. The disclosed process and system cover molds filled with an uncured, hardenable paste with the sheet consisting of or including mesh mat such that the sheet holds the uncured paste in the molds, and the three-dimensional mesh embeds in the paste. When the paste hardens in the molds, the resultant blocks of hardened paste are attached to and are interconnected by the sheet, forming the finished erosion control mat.

In one embodiment of the disclosed process for making an erosion control mat, the process is used for making an erosion control mat consisting of a plurality of blocks of hardened paste attached to and joined together by a sheet of mesh material. A process for making an erosion control mat includes rotating a cylindrical drum having a plurality of mold cavities about an outer surface thereof shaped to form the blocks; depositing a flowable, hardenable paste into the mold cavities; selecting the sheet of mesh material to have sufficient tensile strength to join the blocks of hardened paste together without tearing or separating from the blocks of hardened paste, and to have sufficient density to retain the paste within the mold cavities as the drum rotates; covering an outer surface of the cylindrical drum and outer surfaces of the flowable paste in the mold cavities with the sheet of mesh material as the cylindrical drum rotates; continuing to rotate the cylindrical drum as the flowable, hardenable paste hardens into dimensionally stable blocks in the mold cavities, and holding the sheet of mesh material against the outer surface such that the sheet of mesh material retains the paste within the mold cavities and at least a portion of the sheet of mesh material becomes embedded in the paste; and separating the dimensionally stable blocks from the mold cavities, thereby forming the erosion control mat consisting of the sheet of mesh material embedded in the blocks sufficiently to connect the blocks to each other.

In another embodiment, a process for making an erosion control mat having a plurality of blocks of hardened paste attached to and joined together by a sheet of mesh material is disclosed. The process includes rotating a cylindrical drum on a support surface by displacing a frame on which the cylindrical drum is rotatably mounted relative to the support surface; depositing a flowable, hardenable paste into a hopper adjacent the cylindrical drum such that the hardenable paste flows through an opening in the hopper into mold cavities formed in an outer surface of the cylindrical drum as the mold cavities move into alignment with the opening; paying out a continuous sheet of mesh material from a spindle on a downstream side of the hopper to cover the outer surface of the cylindrical drum and outer surfaces of the paste deposited in the mold cavities, such that the sheet retains the paste within the mold cavities, and at least a portion of the sheet projects into and embeds in the paste in the mold cavities; holding the sheet of mesh material against the outer surface of the cylindrical drum by tension of the sheet of mesh material from resistance of the spindle to rotation and a pinch of the sheet between the cylindrical drum and the support surface; and continuing to displace the frame relative to the support surface at a rate sufficient to rotate the cylinder at a speed that enables the paste to harden into solid blocks in the mold cavities and to embed the sheet in the blocks, thereby forming the erosion control mat of the sheet of flexible, mesh material embedded in the blocks sufficiently to join the blocks into a continuous mat.

In yet another embodiment, a system for making an erosion control mat includes a movable frame; a cylindrical drum having a plurality of mold cavities about a periphery thereof, the cylindrical drum rotatably mounted on the frame; a hopper positioned transversely of the cylindrical drum for receiving and distributing a flowable, hardenable paste into the mold cavities; a sheet having flexible, three-dimensional material supported on the frame and fed to cover an outer surface of the cylindrical drum and outer surfaces of the paste in the mold cavities such that the flexible sheet contacts the paste and retains the paste within the mold cavities, so that the paste hardens in the mold cavities to form the erosion control mat having blocks of hardened paste attached to the flexible sheet.

In still another embodiment, a process for making an erosion control mat consisting of dimensionally stable blocks of hardened paste interconnected by a sheet having a multiplicity of protrusions is disclosed. The process includes depositing a hardenable paste in flowable form into a plurality of molds; covering the molds with the sheet having the multiplicity of protrusions projecting outwardly therefrom, the sheet oriented so that the multiplicity of protrusions extend into and embed in the paste in the plurality of molds; holding the sheet against the molds until the paste hardens sufficiently within the molds to form dimensionally stable blocks attached to the sheet by the multiplicity of protrusions embedded in the plurality of molds; and removing the dimensionally stable blocks from the molds to form the erosion control mat consisting of the dimensionally stable blocks interconnected by the sheet.

In a further embodiment, a process for making an erosion control mat having a plurality of blocks of hardened paste attached to and joined together by a sheet of mesh material is disclosed. The process includes rotating a cylindrical drum having a plurality of mold cavities about an outer surface thereof shaped to form the blocks; depositing a flowable, hardenable paste into the mold cavities; selecting the sheet of mesh material to have sufficient tensile strength to join the blocks of hardened paste together without tearing or separating from the blocks of hardened paste; covering an outer surface of the cylindrical drum and outer surfaces of the flowable paste in the mold cavities with an arcuate shield as the cylindrical drum rotates; continuing to rotate the cylindrical drum as the flowable, hardenable paste hardens in the mold cavities, and holding the arcuate shield against the outer surface such that the arcuate shield retains the paste within the mold cavities; rotating the cylindrical drum over a sheet of matting upon a support beneath the drum, the sheet of matting having upwardly extending filaments, such that the filaments project into and embed in the flowable, hardenable paste; and releasing dimensionally stable blocks of paste from the mold cavities and allowing the dimensionally stable blocks of paste to harden and solidify with the filaments embedded in the blocks, which attaches the blocks to the sheet of matting, thereby forming the erosion control mat of the sheet of mesh material embedded in the blocks sufficiently to connect the blocks to each other.

Other objects and advantages of the disclosed process and system for making an erosion control mat using loop matting will be apparent from the following description, the accompanying drawings, and the appended claims.

DETAILED DESCRIPTION

Figure 1:
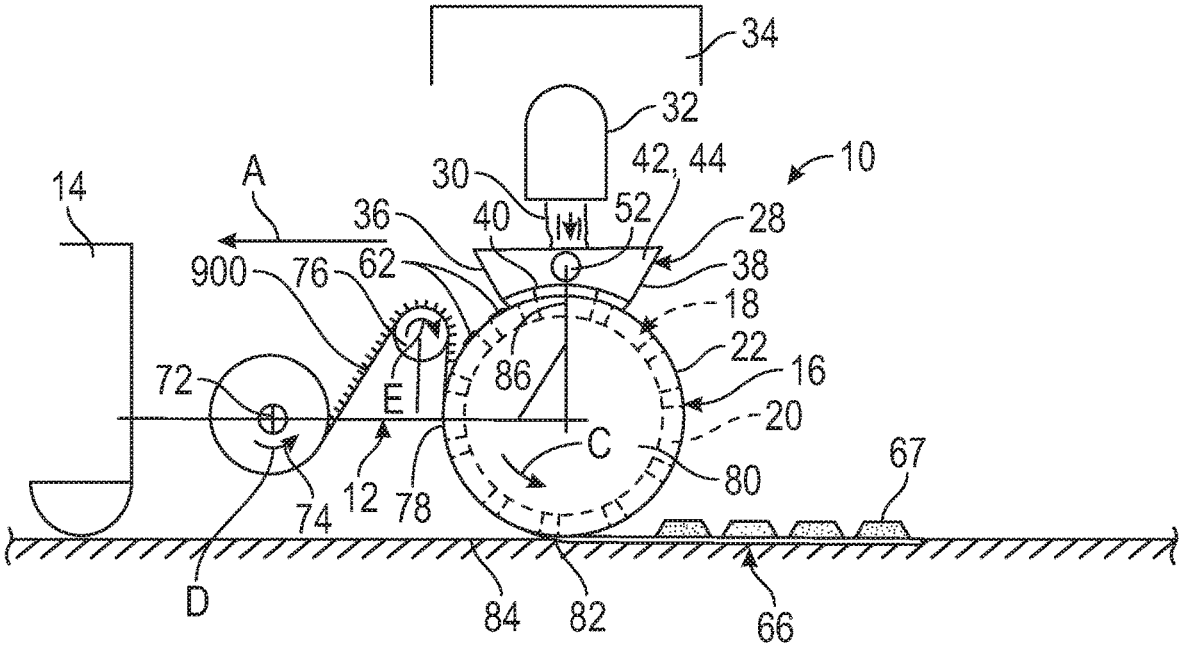
FIG. 1 is a schematic, side elevational view of an embodiment of the disclosed system for making an erosion control mat using loop matting.

As shown in FIG. 1, in an exemplary embodiment, the system for making an erosion control mat, generally designated 10, includes a movable frame 12 that is attached to a motor vehicle 14, such as a tractor or truck. Alternatively, the frame is self-propelled. A cylindrical drum 16 is rotatably attached to the frame 12. The drum 16 has, in an embodiment, a plurality of spaced transverse rows 18 of mold cavities 20 about a periphery thereof (see also FIGS. 3 and 4). In other embodiments, the rows 18 of mold cavities 20 may take the form of different patterns, such as a staggered arrangement, a running bond, or a random pattern about the periphery of the drum 16. Accordingly, as used herein, the term "row" is not limited to a rectilinear arrangement of mold cavities 20 on the drum 16. The mold cavities 20 are recessed from the outer, cylindrical surface 22 of the drum 16.

In an exemplary embodiment, the mold cavities 20 have opposing pairs of radially inward tapering side walls 24 that meet flat bottom walls 26. The shape of the mold cavities 20 thus is an inverted truncated pyramid with rounded corners and edges and a square or rectangular opening. In other embodiments, the side walls 24 do not taper, but instead are perpendicular, or substantially perpendicular to the outer, cylindrical surface 22 of the drum 16. In other embodiments, the side walls 24 of the mold cavities 20 join to form other regular polygonal shaped openings, such as hexagons and octagons. In still other embodiments, the side walls 24 of the mold cavities 20 join to form irregular polygonal openings, rounded openings, such as circular, oval, or elliptical openings, or irregular curvilinear openings. The mold cavities 20 all may be the same size, or may vary in size relative to each other.

In an embodiment, the system 10 includes an elongate hopper, generally designated 28, which is mounted on the frame 12 and is fixed directly above the top of rotating cylindrical drum 16, i.e., at the 12 o'clock position relative to the circular end face 80 of the drum in FIG. 1. The hopper 28 extends transversely along the entire length of the drum 16 and receives a hardenable paste 30, which is received in a wet or flowable form, such as a slurry. The paste 30 is distributed along the length of the hopper and down through an opening in the bottom of the hopper into the mold cavities 20. In embodiments, the hardenable paste 30 may be a fresh, flowable cement paste such as Portland cement, and in a particular embodiment, may be 5000 psi wet-cast Portland cement. In other embodiments, the hardenable paste 30 may be concrete, a mixture of Portland cement, sand, and/or gravel, or an uncured polymer.

In embodiments, the hardenable paste 30 is deposited into the hopper 28 through a conduit or chute 32 from a vehicle 34, such as a front-discharge concrete transport truck or other transport vehicle, that is positioned alongside the frame 12. In embodiments, the elongate hopper 28 is coextensive with the width of the drum 16, or at least with the rows 18 of mold cavities 20. In embodiments, the hopper 28 includes downwardly and inwardly tapering front and rear walls 36, 38, respectively, a bottom wall 40 that is connected to the side walls and is curved to fit or correspond to the curvature of the outer, cylindrical surface 22, and opposing side walls 42, 44 (only side wall 42 is shown, it being understood that side wall 44 is identical in shape) connected to the front and rear walls and the bottom wall.

Figure 4:
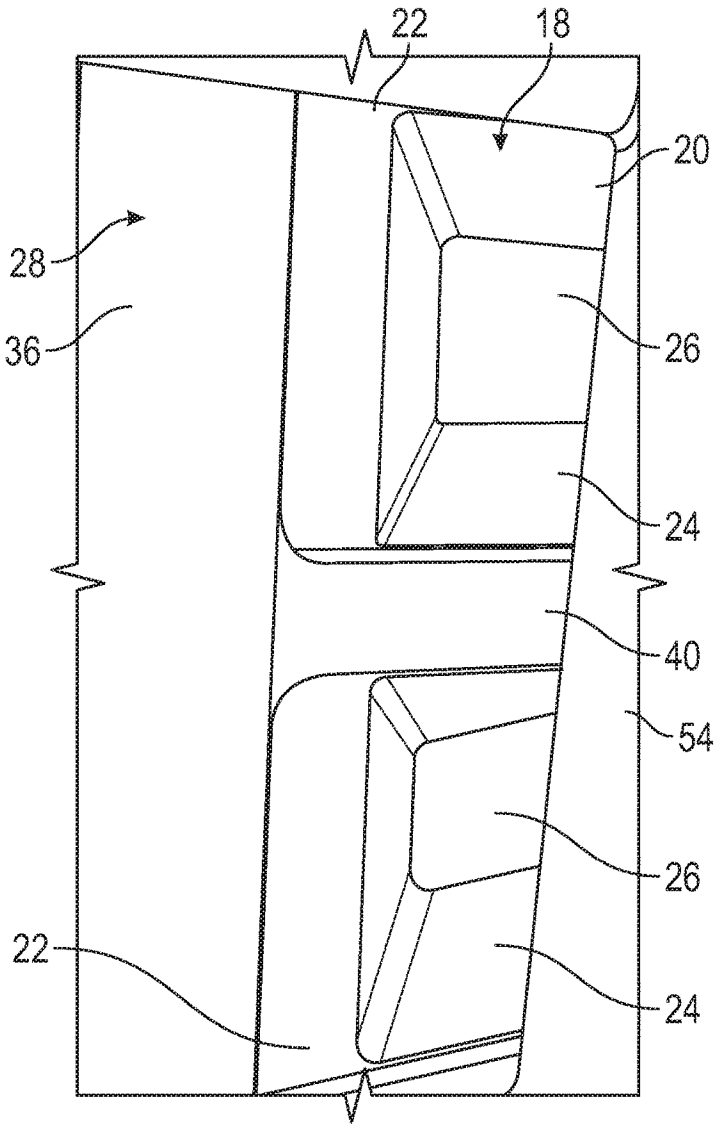
FIG. 4 is a another detail perspective view of the hopper of the embodiment of FIG. 1.
Figure 3:
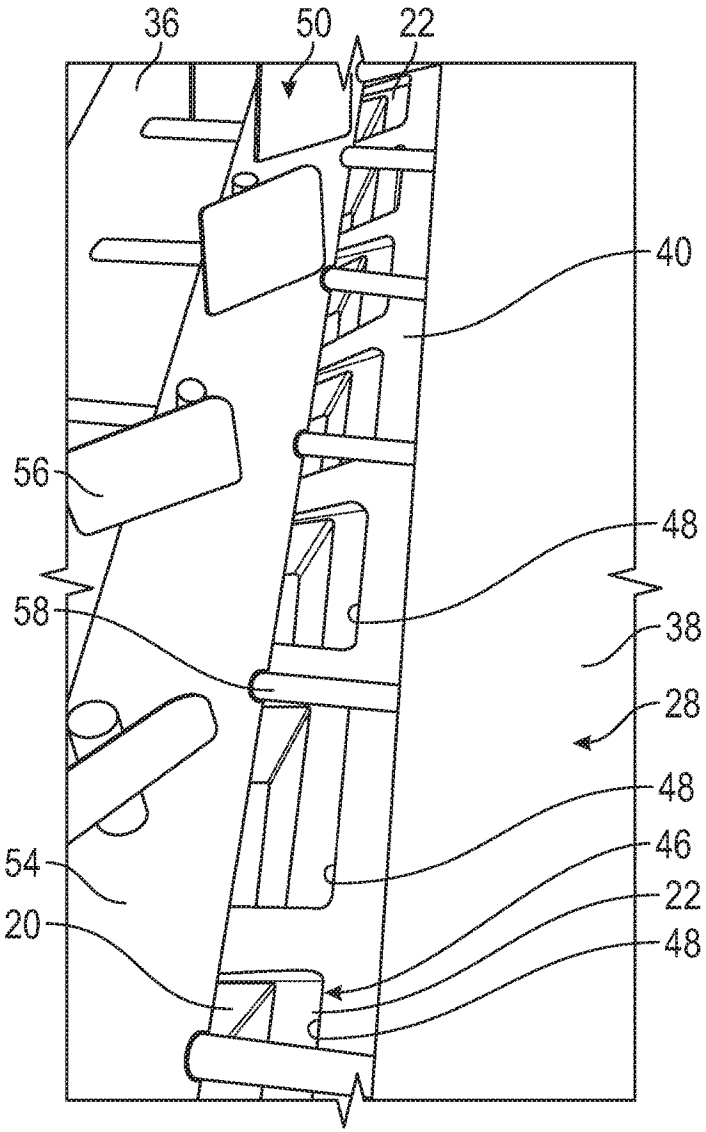
FIG. 3 is a detail perspective view of the hopper of the embodiment of FIG. 1.

As shown in FIGS. 3 and 4, the bottom wall 40 includes an opening 46 that extends the width of the hopper 28 and allows the hardenable paste 30 to flow from the hopper into the mold cavities 20. In embodiments, the opening 46 takes the form of individual holes or elongate slots 48. In embodiments, the slots 48 correspond in longitudinal dimension and/or longitudinal (i.e., along the axial length of the drum 16) spacing to the width dimensions and/or longitudinal spacing of the mold cavities 20. In embodiments, the holes 48 are sized and arranged to correspond in size to, and align with, the mold cavities 20 of each transverse row 18 as the drum 16 rotates beneath the hopper 28. In still other embodiments, the opening 46 takes the form of a continuous and unbroken slot that extends the width of the drum 16 over the mold cavities 20. In other embodiments, the opening 46 is the size of, or substantially the size of, the entire bottom wall 40, so that there is little or no bottom wall. The bottom wall 40 and/or opening 46 are positioned above the top of the drum 16 with minimal clearance, such as less than an inch, to not impede the rotation of the drum but prevent the hardenable paste 30 from flowing from the hopper over the outer surface 22 of the drum between the mold cavities 20.

Although the hopper 28 is shown at, or at approximately the 12 o'clock position relative to the drum 16 in FIG. 1, in other embodiments the hopper is positioned either upstream or downstream of the 12 o'clock position, and anywhere from the 3 o'clock position to the 9 o'clock position relative to the drum 16. With such embodiments, the front wall 36 and rear wall 38 are lengthened to retain the hardenable paste 30 within the hopper 28. The bottom wall 40 and/or opening 46 remain facing the outer surface 22 of the drum 16.

A mixing impeller 50 is rotatably mounted in the end walls 42, 44 of the hopper 28 and distributes the flowable, hardenable paste 30 deposited into the hopper from the chute 32 evenly along the width of the hopper. The mixing impeller 50 is rotated by a motor 52, which drives a shaft 54 that is rotatably mounted to and extends between the end walls 42, 44 of the hopper 28. Paddles 56 are angled relative to a central rotational axis of the shaft 54 for pushing the hardenable paste 30 along the trough 28, and pegs 58 for mixing the paste and facilitating its flowing through the holes 48 of the opening 46 into the mold cavities 20 extend radially outward from the shaft and are spaced along its length.

The system 10 and method for making the disclosed erosion control mat 66 (FIG. 1) utilize a sheet, generally designated 900, having flexible, mesh material, which in embodiments is either an open mesh or a tightly woven impermeable mesh material. In embodiments, the sheet 900 includes a three-dimensional mat of interconnected filaments. As used herein, the term "three-dimensional" refers to a mat having an open weave or mesh component, and the mat having a loft or thickness. In embodiments, the loft or thickness is on the order of at least 5 mm. (0.197 in.) and typically at least 10-15 mm. (0.393-0.590 in) and as much as 20 mm. (0.787 in.). As used herein, the term "two-dimensional" refers to a comparatively flat woven or non-woven fabric or geogrid, which may be on the order of 1-3 mm. (0.039-0.118 in.).

Figure 2A:
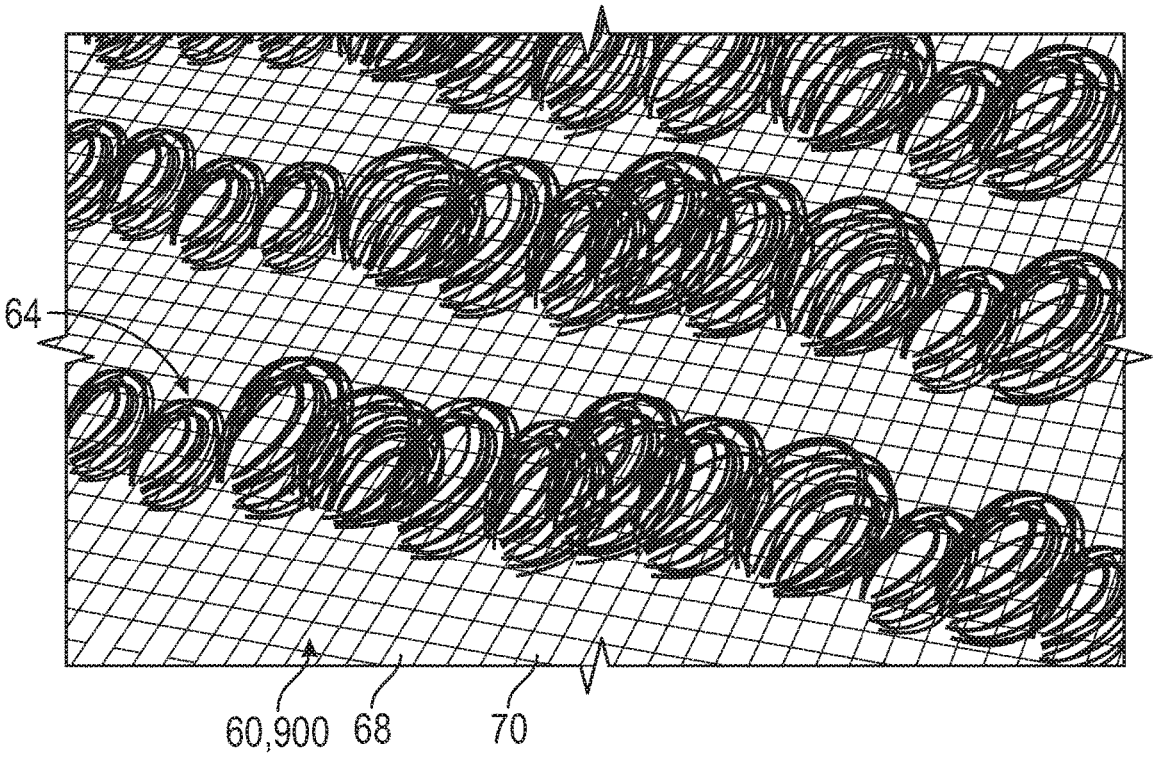
FIGS. 2A and 2B show embodiments of the disclosed sheet having flexible, mesh material in the form of loop matting used in the disclosed method and system in the form of a mat of raised loops of filament attached to a flat, two-dimensional woven geotextile base, and differ by the density of the weave in the mat component.
Figure 2B:
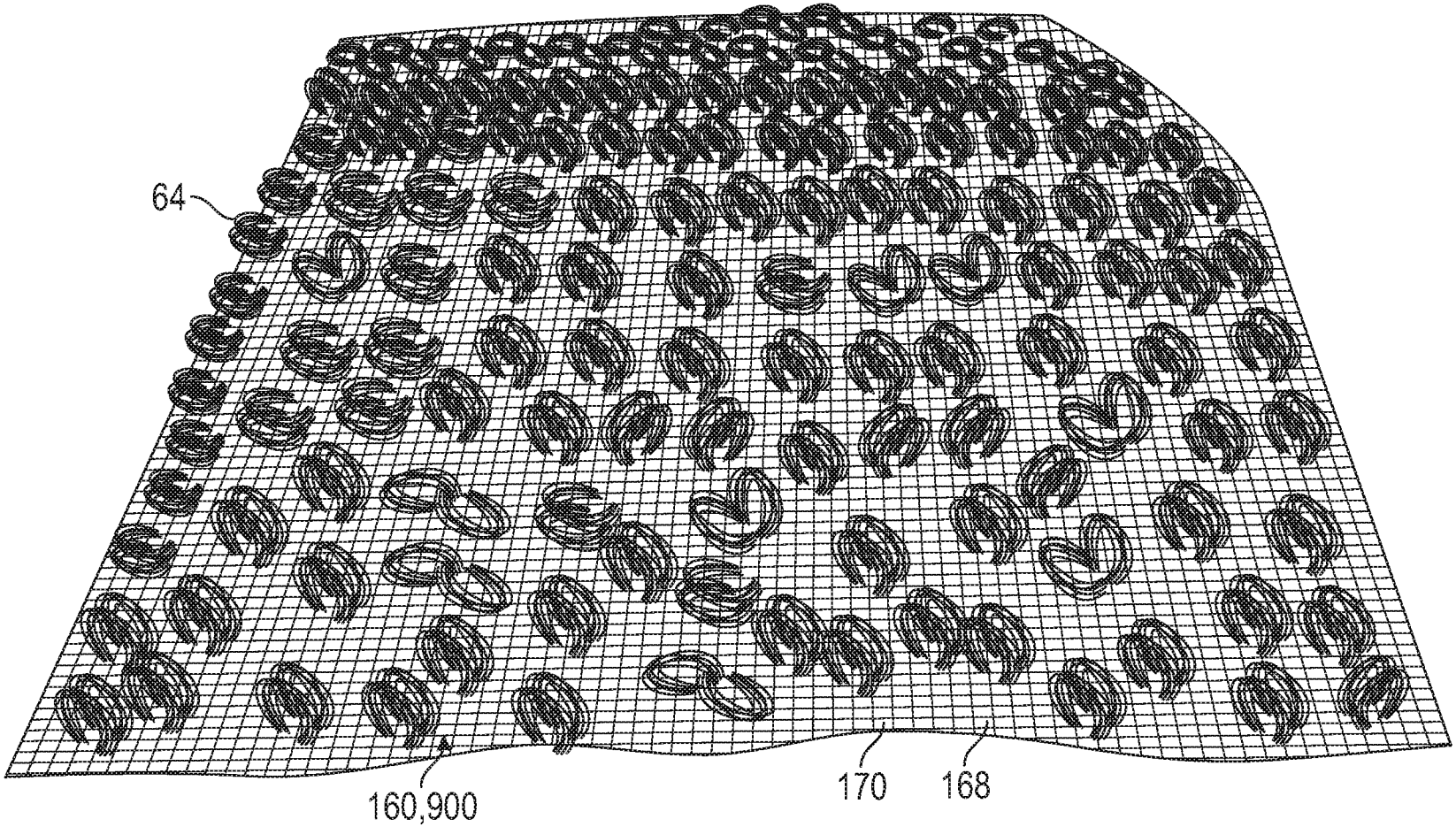

As shown in FIGS. 2A and 2B, in embodiments, the sheet 900 having flexible, mesh material takes the form of loop matting 60, 160 and is supported on the frame 12 and fed to cover the outer surface 22 of the cylindrical drum 16 and outer surfaces 62 of the hardenable paste 30 in the successive rows 18 of the mold cavities 20. The sheet of loop matting 60 retains the hardenable paste 30 within the mold cavities 20 of the successive rows 18, and the loops 64 (see also FIG. 6), also referred to herein as filaments or protrusions, of the sheet of loop matting project into the mold cavities and embed in the hardenable paste in the mold cavities, such that the hardenable paste hardens in the mold cavities to form the erosion control mat 66 having blocks 67 of hardened paste attached to the sheet of loop matting 60, 160 by the loops 64. Thus, the sheet of loop matting 60, 160 alone interconnects the blocks 67 of hardened paste to form the erosion control mat 10. The loops 64 are selected to be sufficiently strong and their connection to the remainder of the sheet 900 is sufficiently strong so that the sheet interconnects the blocks 67 of the mat 10 without need of additional connecting structure.

In embodiments, the sheet of loop matting 60, 160, shown best in FIGS. 2A, 2B, is made of a weather-resistant material, such as polypropylene. The loop matting 60, 160 may include a two-dimensional woven geotextile base 68, 168 on which a three-dimensional mat formed by the addition of loops 64 of geotextile filaments or protrusions is attached, for example by looping the strands through the base, and extend upwardly from a flat surface 70, 170 thereof. In FIG. 2A, the embodiment of the woven base 68 has a relatively tight weave with relatively small or no openings, which would be used to prevent vegetation growth up through the loops 64, or prevent or restrict very fine particulate matter or liquids, such as water, from passing through. In that embodiment, the woven base 68 is a geomembrane form of geosynthetic material, which is impermeable. In FIG. 2B, the embodiment of the woven mat 168 is a relatively loose or open weave, with openings sized to allow vegetation to grow through and/or water to flow through. In that embodiment, the woven mat 168 is a geotextile form of geosynthetic material, which is a permeable fabric. Examples of such sheets of loop matting 60, 160 are sold under the trademark ROBUSTA® by Robusta B.V., Genemuiden, Netherlands.

Figure 2C:
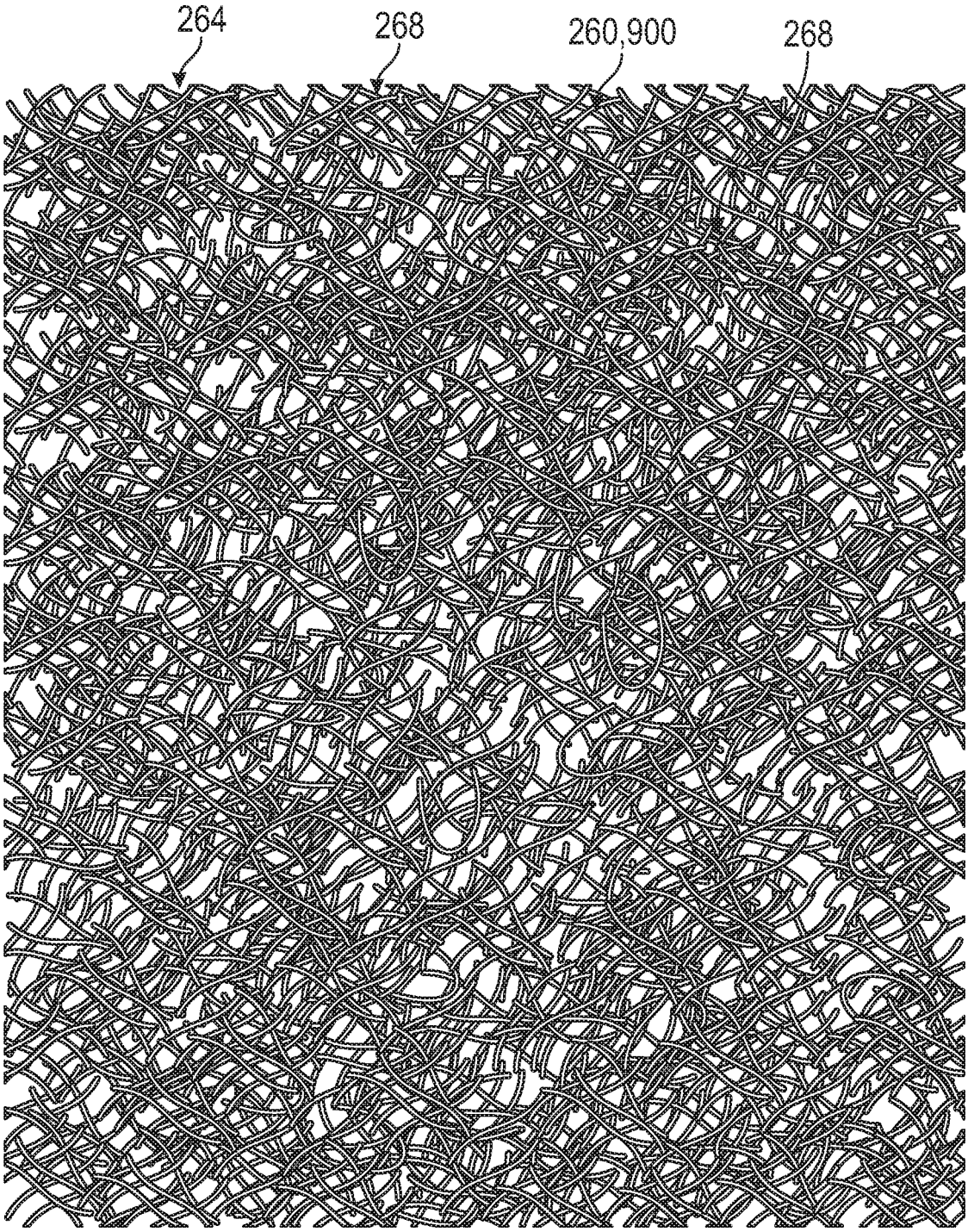
FIG. 2C shows an embodiment of the disclosed sheet having flexible, open mesh material used in the disclosed method and system in the form of a mat of three-dimensional, nonwoven geotextile.

As shown in FIG. 2C, in another embodiment, the sheet 900 of flexible, mesh material is in the form of a three-dimensional nonwoven geotextile 260 with an open structure that is supported on the frame 12 and fed to cover the outer surface 22 of the cylindrical drum 16 and outer surfaces 62 of the hardenable paste 30 in the successive rows 18 of the mold cavities 20. The geotextile 260 is in the form of a three-dimensional mat 264 made up of filaments 268 that are welded where they cross. In embodiments, the filaments 268 are polyamide monofilaments, and are randomly interconnected to provide thickness or loft to the mat 264 of up to, or approximately, 20 mm. (0.787 in.). The open structure and density of the filaments 268 are selected so that the filaments of the mat 264 penetrate the hardenable paste 30 in the molds 20, but prevent the paste from flowing through the mat. Such a geotextile 260 is commercially available as Enkamat® from Low & Bonar PLC, London, United Kingdom.

Figure 2D:
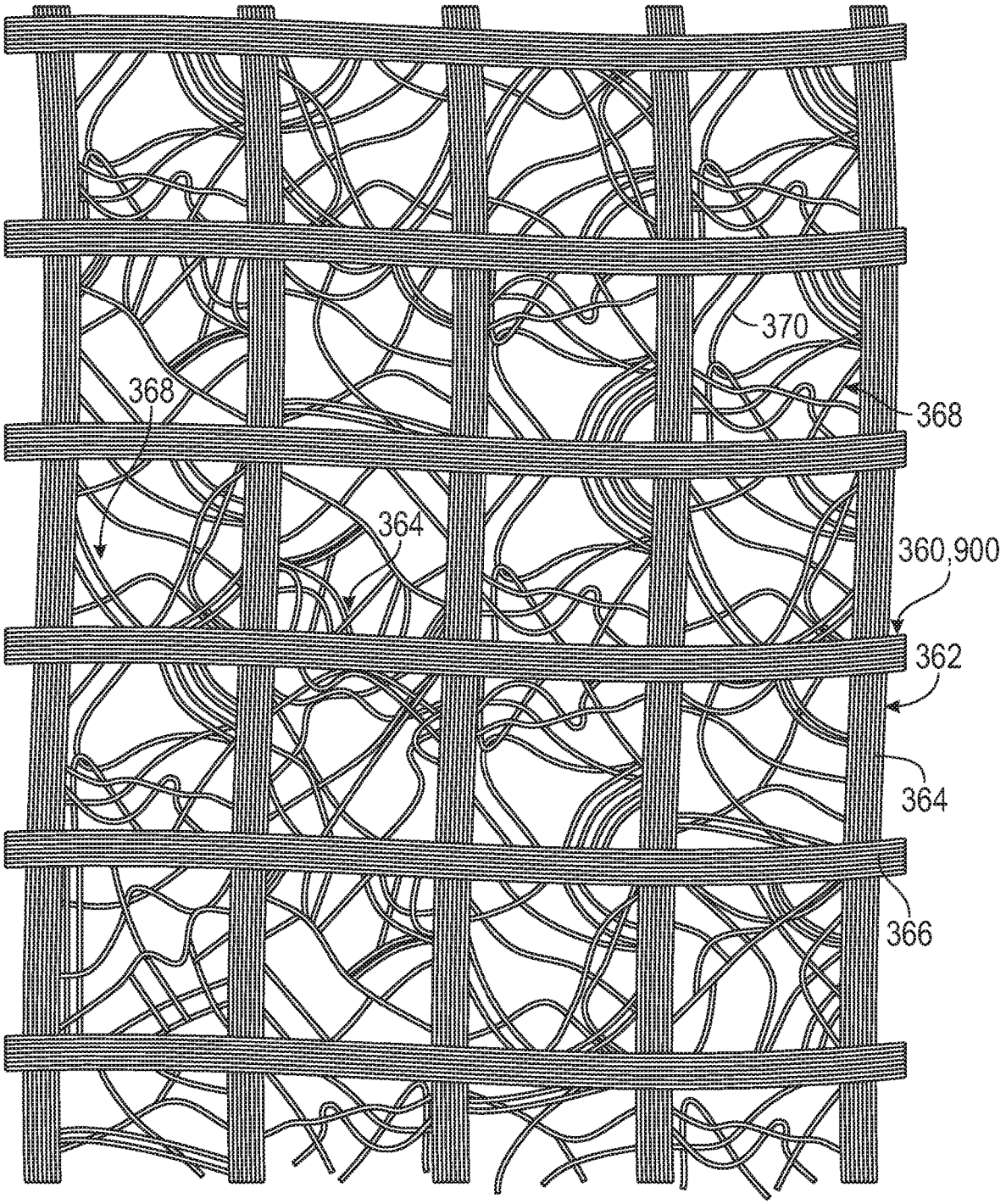
FIG. 2D shows an embodiment of the disclosed sheet having flexible, open mesh material used in the disclosed method and system in the form of a mat of three-dimensional, nonwoven filaments bonded to a geogrid base.

As shown in FIG. 2D, in another embodiment, the sheet 900 of flexible, mesh material is in the form of a reinforced three-dimensional geotextile 360 with an open structure that is supported on the frame 12 and fed to cover the outer surface 22 of the cylindrical drum 16 and outer surfaces 62 of the hardenable paste 30 in the successive transverse rows 18 of the mold cavities 20. The geotextile 360 includes a base 362 in the form of a reinforcing geogrid, consisting of longitudinal and transverse components 364, 366, respectively, bonded to each other at intersection points. The two-dimensional geogrid base 362 is attached to a three-dimensional mat 368 of randomly oriented and interconnected filaments 370 bonded to each other where they cross to form an open mesh. The filaments 370 provide the loft and three-dimensional property to the mat 368 of the geotextile 360, projecting upwardly from the comparatively flat geogrid base 362 to define open space adjacent the geogrid.

In embodiments, the geogrid base 362 is made of a high-tensile polyester bonded to the mat 368 of filaments 370, which in embodiments are polyamide monofilaments thermally fused to each other at intersection points. The geotextile 360 is applied to the outer surface 22 of the cylindrical drum 16 and outer surfaces of the hardenable paste 30 such that the geogrid base 362 faces radially outward, and the three-dimensional mat 368 faces radially inward, so that the filaments 370 extend into the hardenable paste 30 in the mold cavities 20. The open structure and density of the filaments 370 are selected so that the filaments of the mat 368 penetrate the hardenable paste 30 in the molds 20, but prevents the paste from flowing through the mat. Such a geotextile 360 is commercially available as Enkamat® R from Low & Bonar PLC, London, United Kingdom.

Figure 2E:
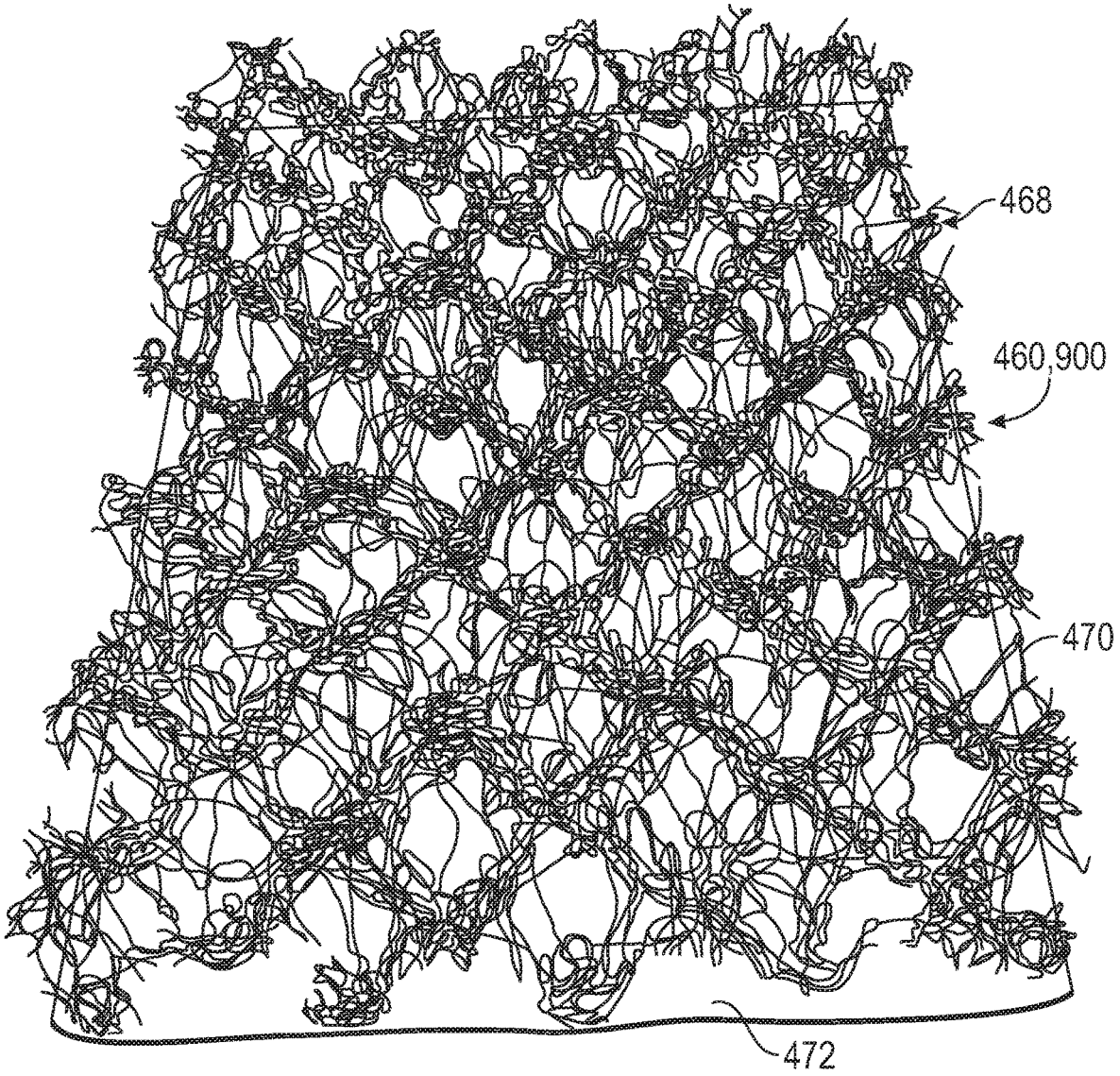
FIGS. 2E and 2F show an embodiment of the disclosed sheet having flexible, mesh material used in the disclosed method and system in the form of a three-dimensional mat of interconnected filaments attached to a relatively flat, two-dimensional fabric base.
Figure 2F:
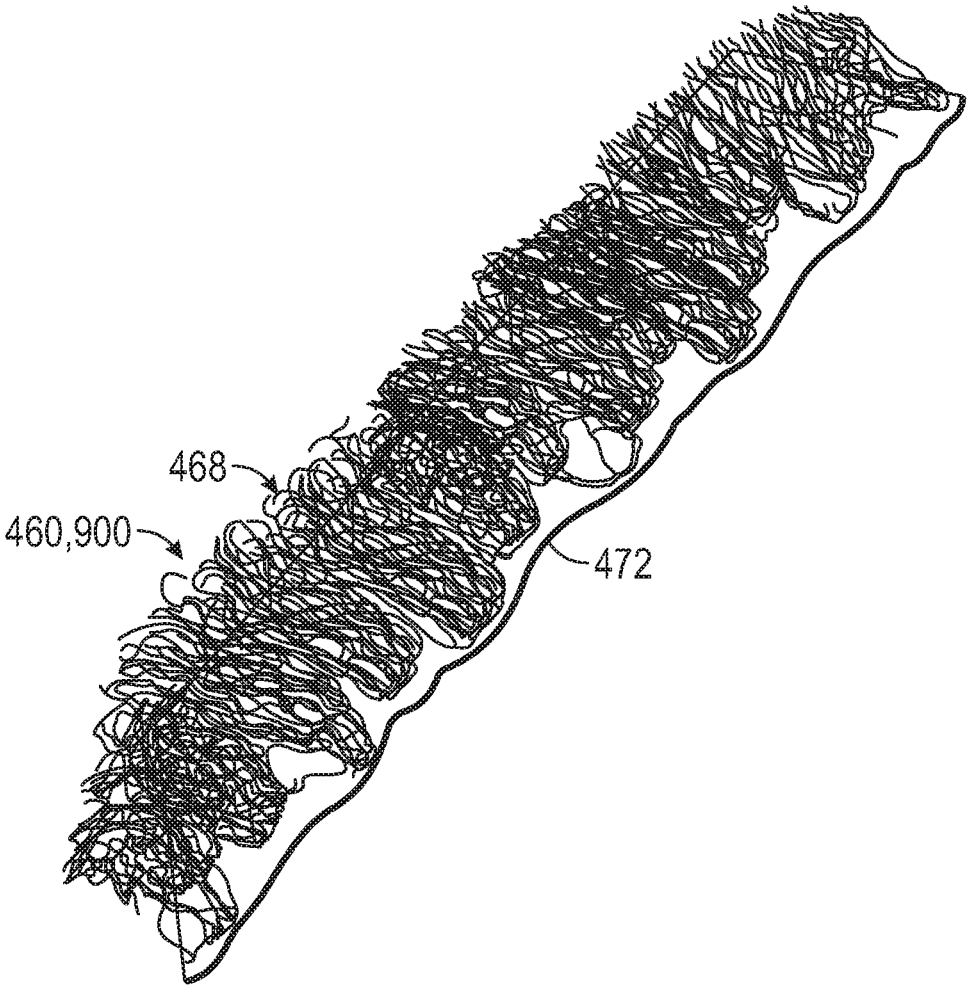

As shown in FIGS. 2E and 2F, in another embodiment, the sheet 900 of flexible, mesh material is in the form of a three-dimensional nonwoven geocomposite 460 with an open structure that is supported on the frame 12 and fed to cover the outer surface 22 of the cylindrical drum 16 and outer surfaces 62 of the hardenable paste 30 in the successive rows 18 of the mold cavities 20. The geocomposite 460 is in the form of a three-dimensional mat 468 consisting of randomly oriented filaments 470 bonded to each other where they cross. The filaments 470 also are bonded, for example heat bonded, to a base 472 in the form of a geotextile fabric sheet. The filaments 470 provide the loft and three-dimensional quality to the geocomposite 460, and project upwardly from the comparatively flat and thinner base 472.

In embodiments, the three-dimensional mat 468 is made of nylon monofilaments fused together at their intersections. In embodiments, the mat 468 is a 95% open structure. The base 472 is a polyester geotextile fabric. In embodiments, the fabric is an 8 ounce fabric. The geocomposite 460 is applied to the outer surface 22 of the cylindrical drum 16 and outer surfaces of the hardenable paste 30 such that the base 472 faces radially outward, and the three-dimensional mat 468 faces radially inward, such that the filaments 470 extend into the hardenable paste 30 in the mold cavities 20. In an embodiment, the open structure and density of the filaments 470 are selected so that the filaments of the mat 468 penetrate the hardenable paste 30 in the molds 20, but prevent the paste from flowing through the mat. In other embodiments, the density of the sheet 472 prevents the paste 30 from flowing through the geotextile 460. Such a geocomposite 460 is commercially available as Enkamat® Plus 7420 from Low & Bonar PLC, London, United Kingdom.

Figure 2G:
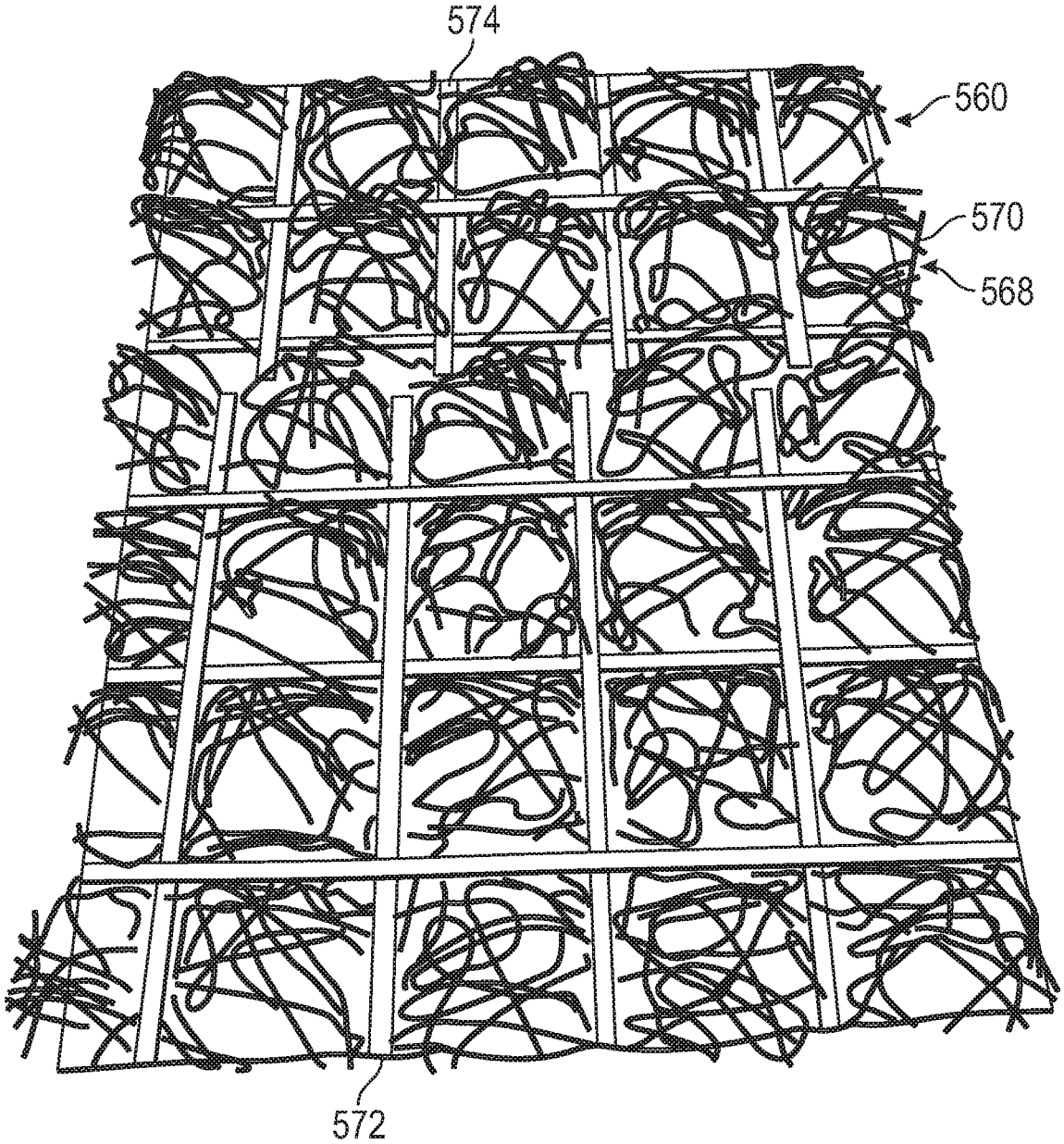
FIGS. 2G and 2H show an embodiment of the disclosed sheet having flexible, mesh material used in the disclosed method and system in the form of a mat of three-dimensional, non-woven filaments attached to a relatively flat, two-dimensional fabric base.
Figure 2H:
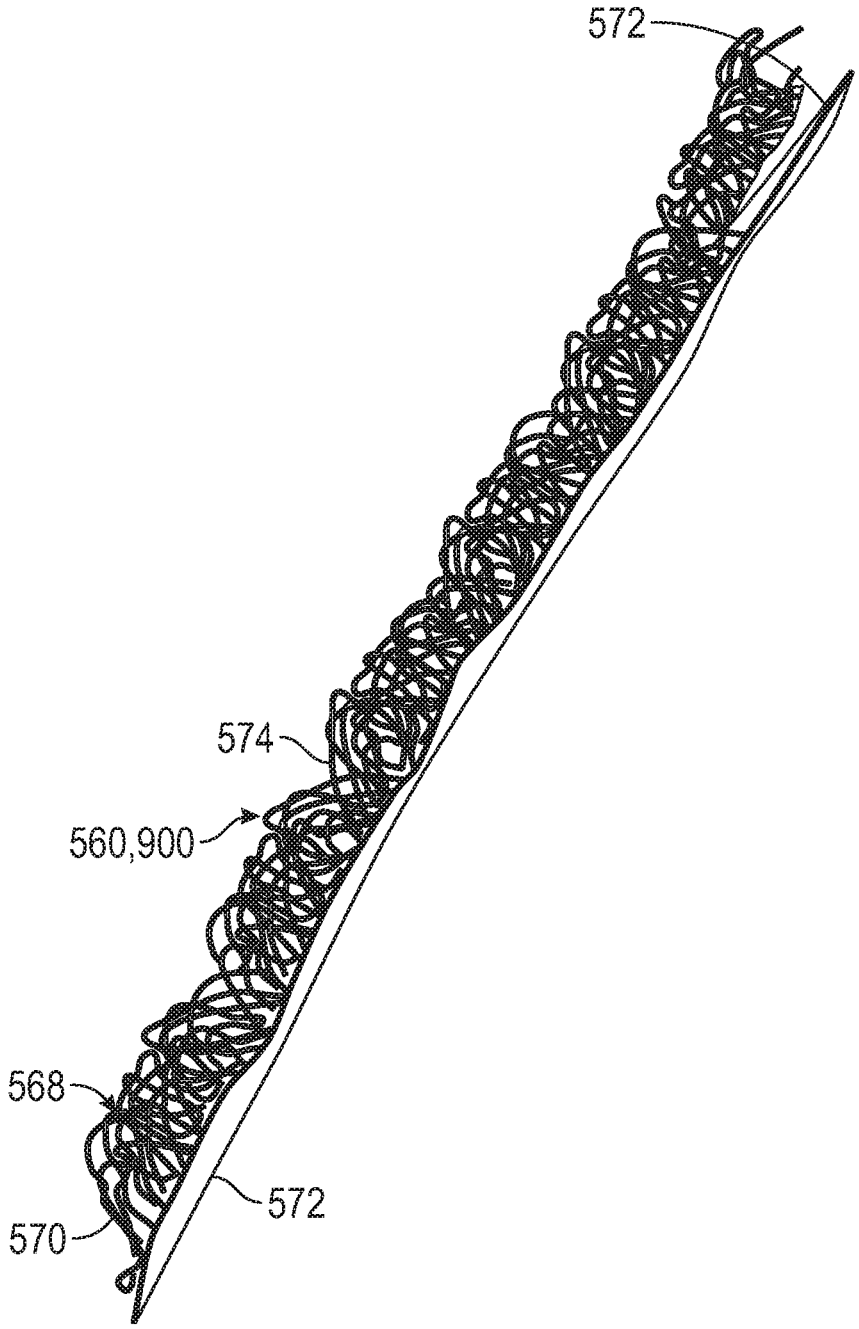

As shown in FIGS. 2G and 2H, in another embodiment, the sheet 900 of flexible, mesh material is in the form of a geocomposite 560 that is supported on the frame 12 and fed to cover the outer surface 22 of the cylindrical drum 16 and outer surfaces 62 of the hardenable paste 30 in the successive transverse rows 18 of the mold cavities 20. The geocomposite 560 is in the form of a three-dimensional mat 568 consisting of randomly oriented filaments 570 bonded to each other where they cross. The filaments 570 are bonded, for example heat bonded, to a base 572 of a two-dimensional geotextile fabric. In other embodiments, the base 572 is in the form of a two-dimensional geomembrane. The filaments 570 provide the loft and three-dimensional quality to the geocomposite 560, and project upwardly from the comparatively flat and thinner base 572.

In embodiments, the three-dimensional mat 568 is made of randomly oriented polypropylene filaments 570, in particular post-industrial recycled polypropylene, fused, entangled filaments, which in embodiments are fused together at their intersections. The base 572 is a two-dimensional nonwoven geocomposite fabric bonded or spot welded to one surface of the mat 568. The filaments 570 are attached in squares in a waffle pattern to the base 572, the waffle pattern formed by intersecting grid lines 574 where the mat 568 is fused to the base 572.

In embodiments, the fabric is an 8 ounce fabric. The geocomposite 560 is applied to the outer surface 22 of the cylindrical drum 16 and outer surfaces of the hardenable paste 30 such that the sheet 572 faces radially outward, and the three-dimensional mat 568 faces radially inward, such that the filaments 570 extend into the hardenable paste 30 in the mold cavities 20. In an embodiment, the open structure and density of the filaments 570 are selected so that the filaments of the mat 568 penetrate the hardenable paste 30 in the molds 20, but prevent the paste from flowing through the mat. In other embodiments, the density of the base 572 prevents the paste 30 from flowing through the geocomposite 560. Such a geocomposite 560 is commercially available as Enkadrain® 3611 from Low & Bonar PLC, London, United Kingdom.

Figure 2I:
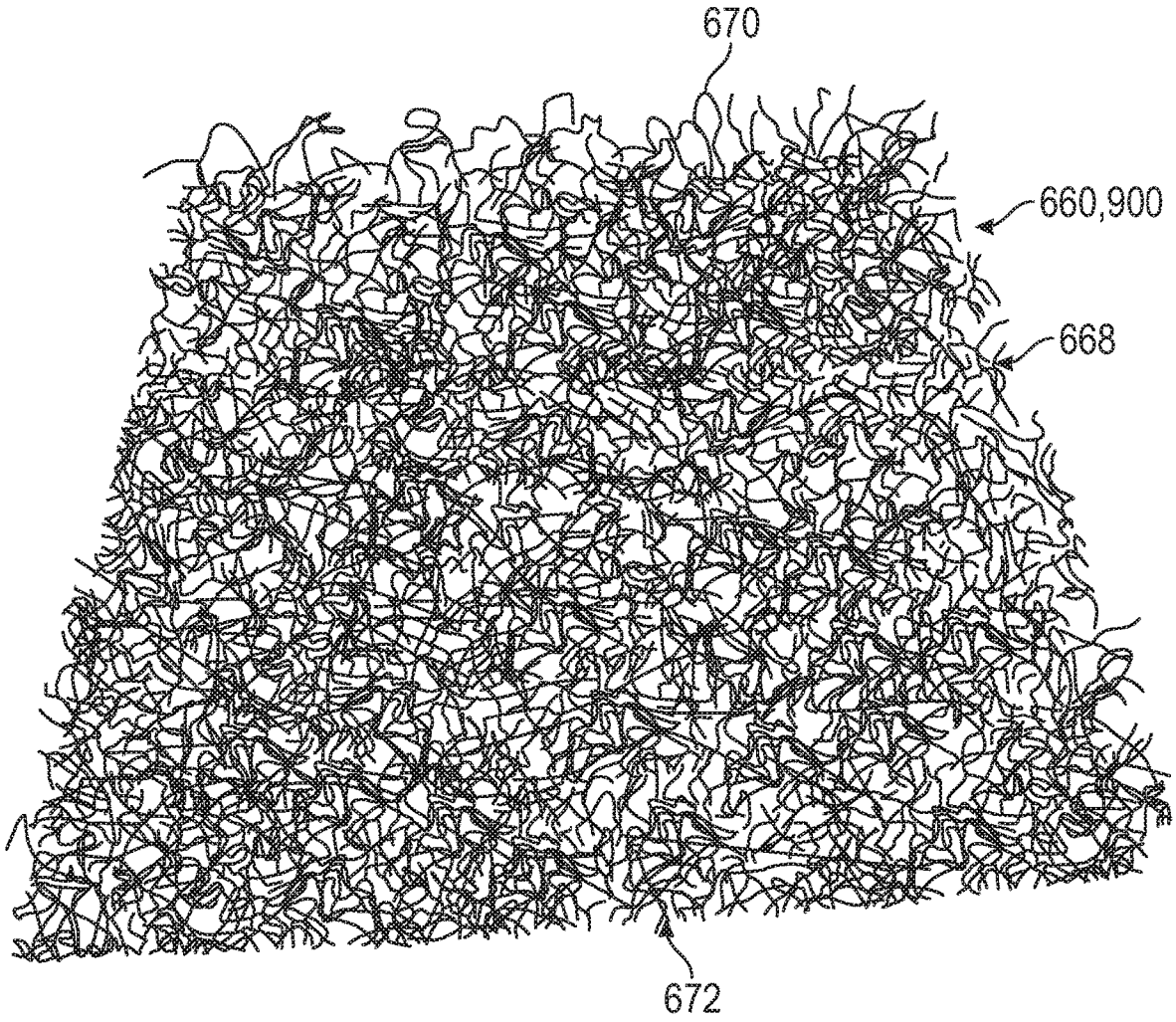
FIGS. 2I and 2J show an embodiment of the disclosed sheet having flexible, open mesh material used in the disclosed method and system in the form of a three-dimensional mat attached to a relatively flat, dense mesh base.
Figure 2J:
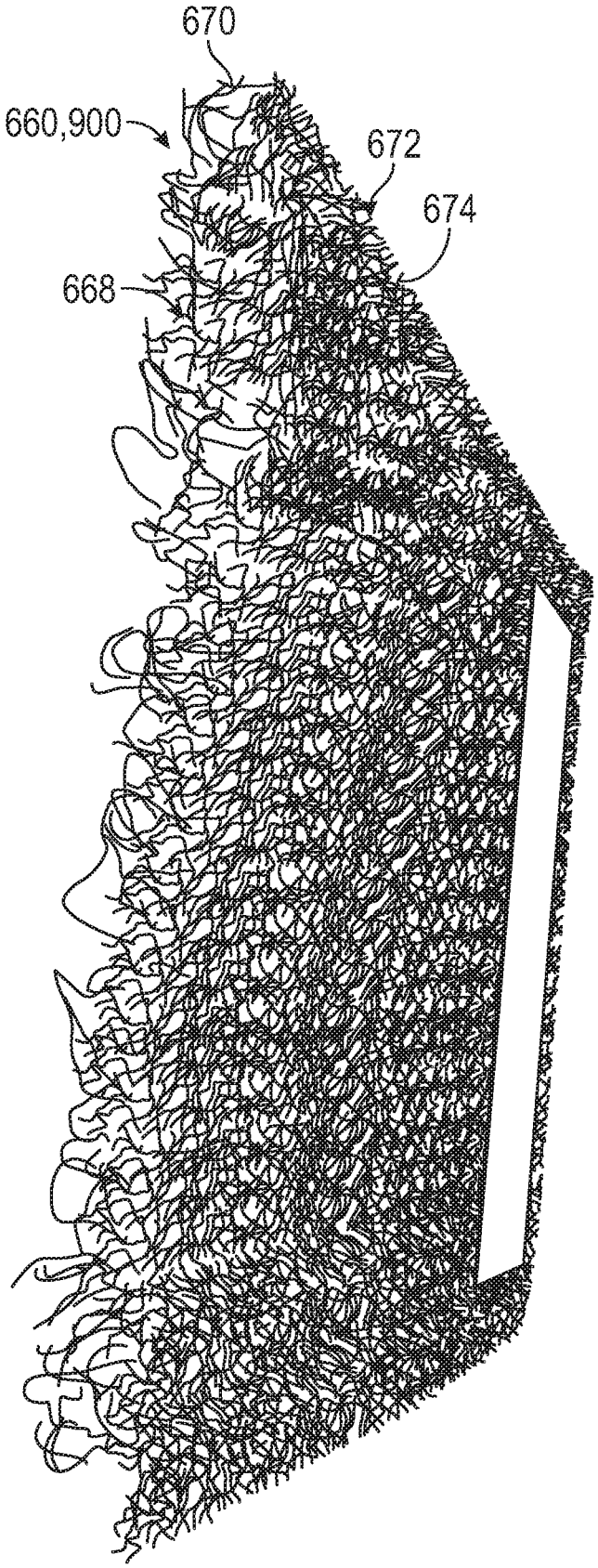

As shown in FIGS. 2I and 2J, in another embodiment, the sheet 900 of flexible, mesh material is in the form of a geotextile 660 with an open structure that is supported on the frame 12 and fed to cover the outer surface 22 of the cylindrical drum 16 and outer surfaces 62 of the hardenable paste 30 in the successive rows 18 of the mold cavities 20. In embodiments, the geotextile 660 is in the form of a three-dimensional mat 668 consisting of randomly oriented filaments 670 bonded to each other where they cross. The filaments 670 are bonded to a flat, two-dimensional base 672 of nonwoven filaments 674 that are fused to each other in a relatively denser pattern. The filaments 670 provide the loft and three-dimensional quality to the geotextile 660, and generally project upwardly from the comparatively flat and thinner base 672 and are oriented to extend into the mold cavities 20 and embed in the hardenable paste 30.

In embodiments, the filaments 670, 674 are made of randomly oriented polyamide monofilaments that are welded where they cross. In embodiments, the geotextile 660 is, or is approximately, up to 20 mm. (0.787 in.) thick. The geotextile 660 is applied to the outer surface 22 of the cylindrical drum 16 and outer surfaces of the hardenable paste 30 such that the base 672 faces radially outward, and the three-dimensional mat 668 faces radially inward, so that the filaments 670 extend into the hardenable paste 30 in the mold cavities 20. In an embodiment, the open structure and density of the filaments 670 are selected so that the filaments of the mat 668 penetrate the hardenable paste 30 in the molds 20, but prevent the paste from flowing through the mat. In other embodiments, the density of the two-dimensional flat base 672 prevents the paste 30 from flowing through the geotextile 660. Such a geotextile 660 is commercially available as Enkamat® 7220 from Low & Bonar PLC, London, United Kingdom. The flat underside of the two-dimensional flat sheet 672 presents continuous flat surface or face to the surface upon which the formed erosion control mat 66 is placed.

Figure 2K:
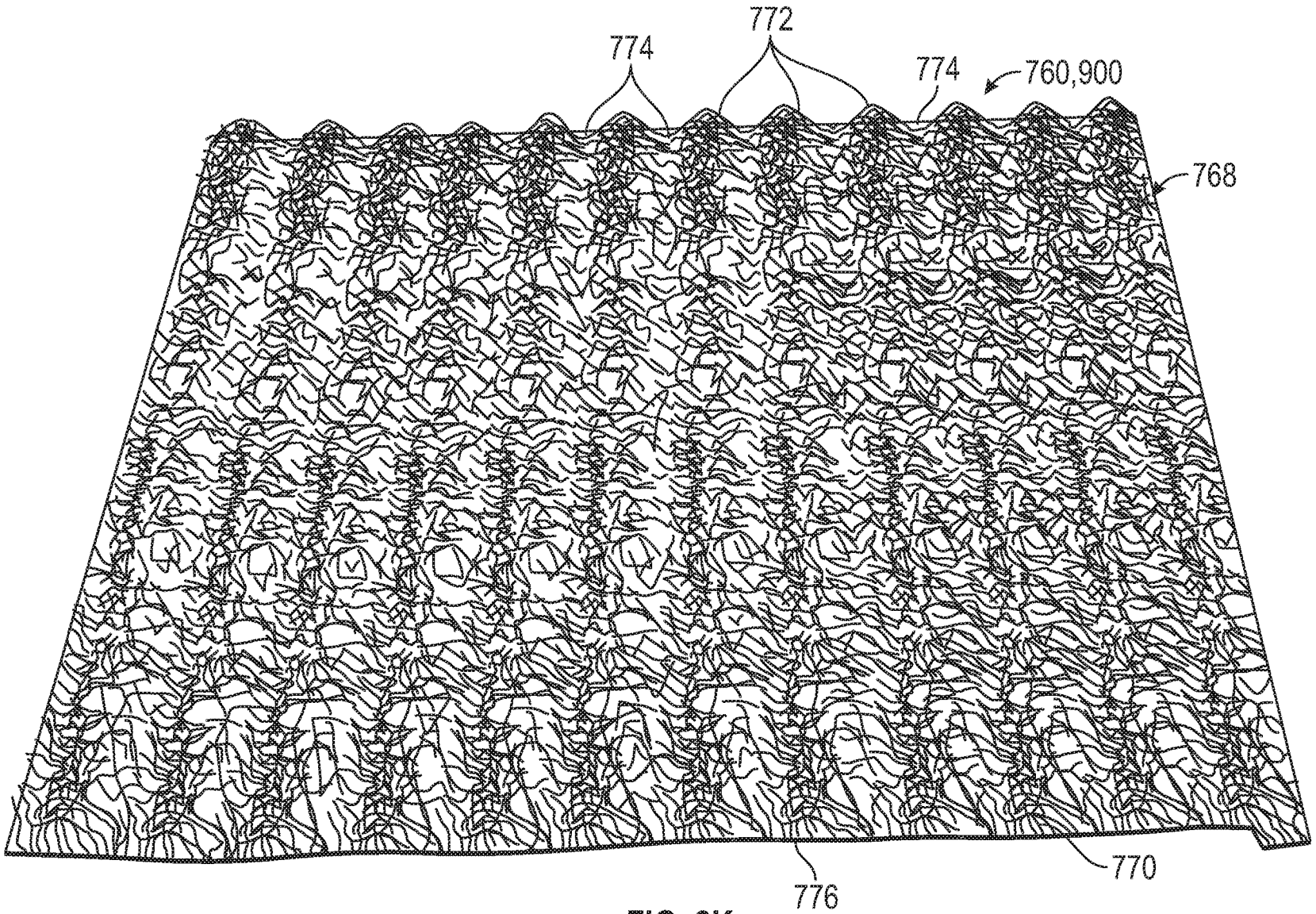
FIGS. 2K, 2L, and 2M show an embodiment of the disclosed sheet having flexible, open mesh material used in the disclosed method and system in the form of a three-dimensional undulating mat bonded to a flat, two-dimensional non-woven fabric sheet base.
Figure 2L:
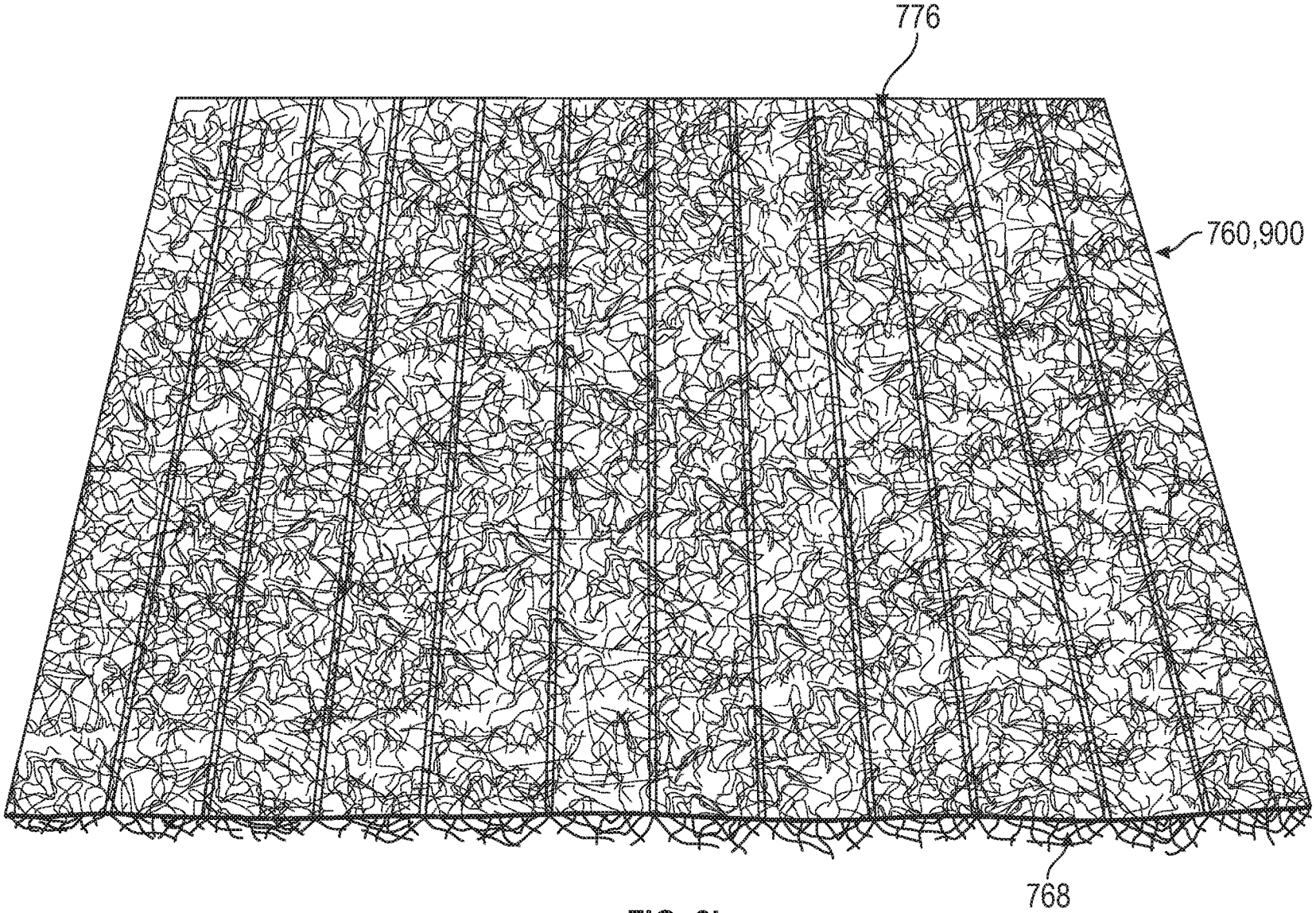
Figure 2M:
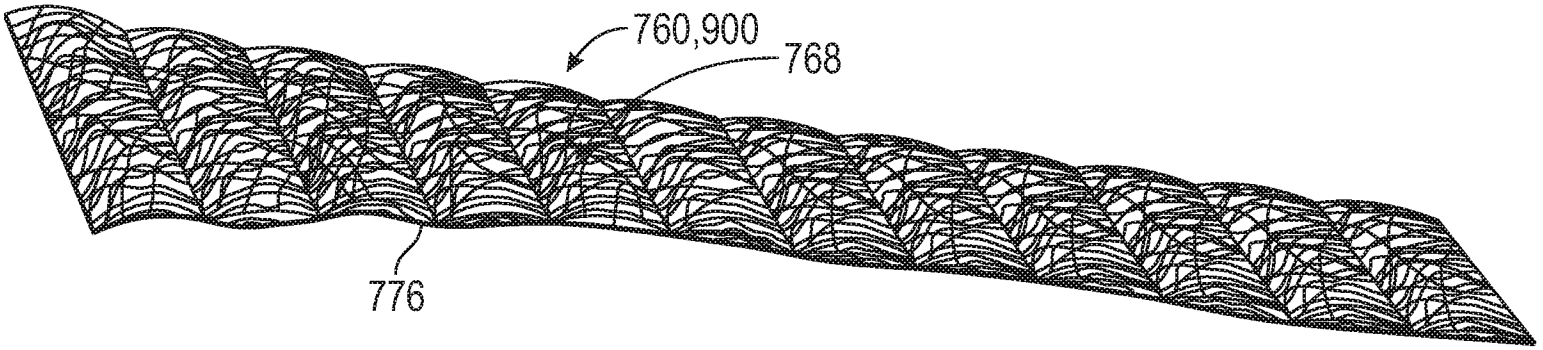

As shown in FIGS. 2K, 2L, and 2M, in another embodiment, the sheet 900 is of a flexible, mesh material in the form of a three-dimensional nonwoven geocomposite 760 with an open structure that is supported on the frame 12 and fed to cover the outer surface 22 of the cylindrical drum 16 and outer surfaces 62 of the hardenable paste 30 in the successive rows 18 of the mold cavities 20. The geocomposite 760 is in the form of a three-dimensional mat 768 consisting of randomly oriented, entangled filaments 770 bonded to each other where they cross. The filaments 770 are heat formed into parallel, inverted U-shaped ridges 772 separated by channels 774.

The filaments 770 are bonded, for example heat bonded, to a flat, two-dimensional geotextile fabric base 776. In embodiments, the base 776 is made of non-woven filaments of a polymer, such as polyethylene terephthalate (PET). In embodiments, the channels 774 are formed by parallel lines fusing or spot welding the filaments 770 of the mat 768 to the base 776. The filaments 770 provide the loft and three-dimensional quality to the geocomposite 760, and project upwardly from the comparatively flat and thinner base 776.

In embodiments, the geocomposite 760 is applied to the outer surface 22 of the cylindrical drum 16 and outer surfaces of the hardenable paste 30 such that the base 776 faces radially outward, and the three-dimensional mat 768 faces radially inward, so that the filaments 770 extend into the hardenable paste 30 in the mold cavities 20. In an embodiment, the open structure and density of the filaments 770 are selected so that the filaments of the mat 768 penetrate the hardenable paste 30 in the molds 20, but prevent the paste from flowing through the mat. In other embodiments, the density of the base 776 prevents the paste 30 from flowing through the geotextile 760. Such a geocomposite 760 is commercially available as Enkadrain® 3601 from Low & Bonar PLC, London, United Kingdom.

Figure 2N:
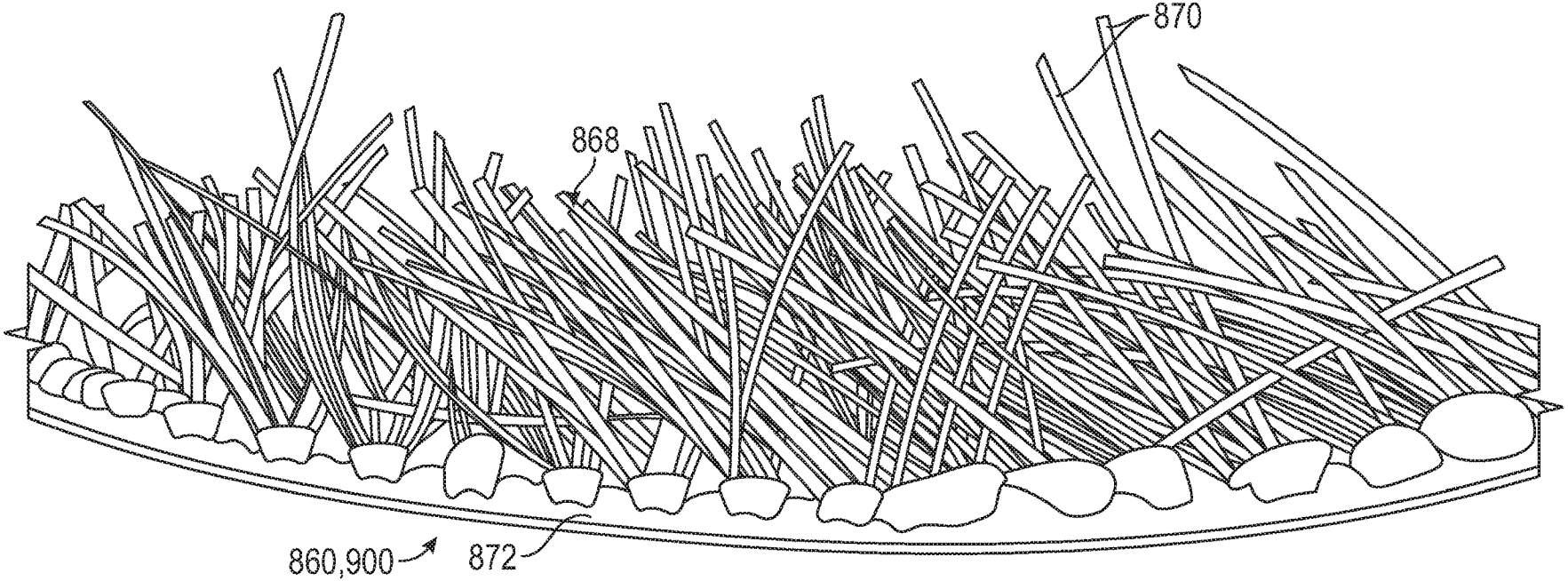
FIG. 2N shows an embodiment of the disclosed sheet having flexible mesh material used in the disclosed method and system in the form of a three-dimensional mat with upwardly extending filaments bonded to a flat, two-dimensional geomembrane.

As shown in FIG. 2N, in another embodiment, the sheet 900 of flexible material is in the form of a three-dimensional geocomposite 860 that is supported on the frame 12 and fed to cover the outer surface 22 of the cylindrical drum 16 and outer surfaces 62 of the hardenable paste 30 in the successive transverse rows 18 of the mold cavities 20. The geocomposite 860 is in the form of a three-dimensional mat 868 that includes randomly oriented filaments 870 that in embodiments are formed to have the shape and color of blades of grass, thus giving the appearance of turf to the geocomposite 860 when viewed from above. Accordingly, in embodiments the geocomposite 860 is a synthetic turf. The filaments 870 are bonded, for example heat bonded, to a base 872 that, in embodiments, takes the form of a permeable geotextile fabric sheet. In an alternate embodiment, the base 872 is in the form of an impermeable geomembrane of geosynthetic material. In either case, the base 872 may be woven or nonwoven. The filaments 870 in embodiments are bonded to the base 872 at their ends and project upwardly from the base. The filaments 870 thus provide the loft and three-dimensional quality to the geocomposite 860 by projecting upwardly from the comparatively flat and thinner base 872.

In embodiments, the filaments 870 of the three-dimensional mat 868 are made of nylon or polyester monofilaments. The base 872 is a woven or nonwoven geotextile fabric that may be polyester. The geocomposite 860 is applied to the outer surface 22 of the cylindrical drum 16 and outer surfaces of the hardenable paste 30 such that the base 872 faces radially outward, and the three-dimensional mat 868 faces radially inward, such that the filaments 870 extend into the hardenable paste 30 in the mold cavities 20. In an embodiment, the open structure and density of the filaments 470 are selected so that the filaments of the mat 868 penetrate the hardenable paste 30 in the molds 20, but prevent the paste from flowing through the mat. In other embodiments, the density of the sheet 872 prevents the paste 30 from flowing through the geotextile 460. An embodiment of such a geocomposite 860 is commercially available as HydroTurf® CS or HytroTurf® Z manufactured by Watershed Geosynthetics LLC of Alpharetta, Ga.

As shown in FIG. 1, in embodiments, the system 10 further includes a spindle 72 rotatably mounted on the frame 12 in front of the drum 16 in the direction of travel of the frame, indicated by arrow A. The spindle 72 contains a coil 74 of the sheet 900 of mesh material, which may take the form of loop matting 60, 160, geotextile 260, geotextile 360, geocomposite 460, geotextile 560, geotextile 660, geocomposite 760, geocomposite 860, or combinations thereof. In embodiments, the sheet 900 is wound on the spindle 72. For loop matting 60, 160, geocomposites 460, 760, geotextile 560, and geocomposite 860, the sheet 900 is wound such that the three-dimensional component thereof extends radially outward from the center of the coil 74 so that when the sheet 900 covers the outer surface 22 of the drum 20. The three-dimensional component of the sheet 900, for example loops 64 of loop matting 60, 160, extends into the mold cavities 20, and embeds into the hardenable paste 30 within the mold cavities.

Also in embodiments, the system 10 further includes an idler roller 76 rotatably mounted on the frame 12 between the spindle 72 and the cylindrical drum 16. The idler roller 76 extends the width of the cylinder 16, or at least the width of the sheet 900, which in embodiments also is at least as wide as the transverse rows of mold cavities 18, and preferably wider to provide a border beyond the blocks 68 (see FIG. 5). The sheet 900 extends from the bottom of the coil 74, passes over the top of the idler roller 76, and downwardly from the idler roller to cover the outer surface 22 of the cylindrical drum 16 and outer surfaces 62 of the hardenable paste 30 in the mold cavities 20. In embodiments, the idler roller 76 is positioned relative to the drum 16 such that the sheet 900 covers at least the lower half of the downstream portion (and in embodiments, part of the upper half) of the outer surface 22 of the drum 16. The downstream portion of the outer surface 22 of the drum 16 is the portion whose mold cavities contain hardenable paste 30 deposited by the hopper 28.

The spindle 76 is positioned downstream of the hopper 28. The sheet 900 from the idler roller 76 contacts the outer cylindrical surface 22 of the drum 16 at, or at approximately, the 9 o'clock position 78 relative to the circular end 80 of the drum, and continues to contact and completely cover the outer cylindrical surface and the outer surfaces 62 of the hardenable paste 30 in the mold cavities 20, which are flush with the outer surface of the drum 16, as the drum rotates the mold cavities to the 6 o'clock or lowermost position 82, where the loop matting 60, 160 contacts a support surface 84, which in embodiments is the ground, which may be dirt, gravel, asphalt pavement, or concrete pavement. In other embodiments, the support surface 84 may take the form of a cover, such as a plastic or a fiber mat over the ground, and in still other embodiments, a prepared surface of crushed rock.

Figure 7:
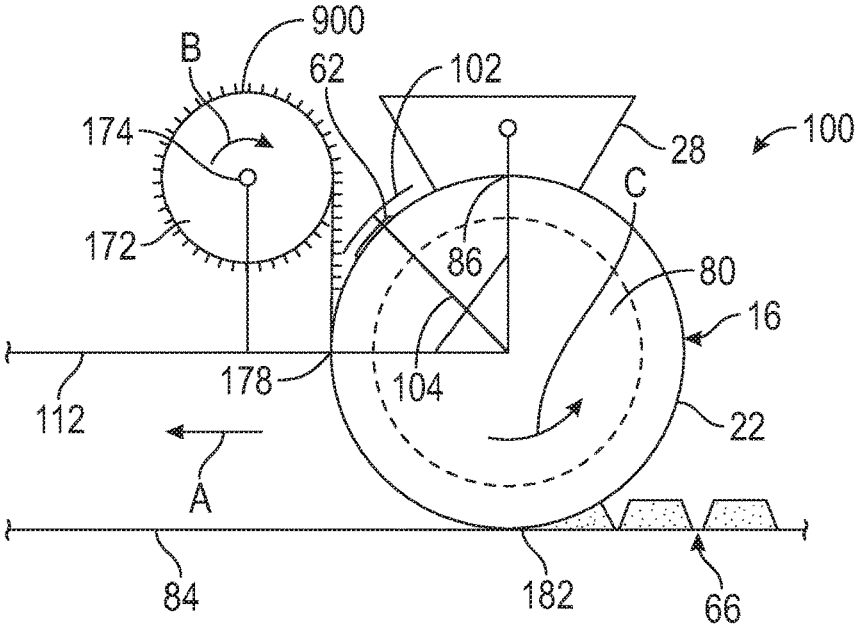
FIG. 7 is another embodiment of the disclosed system for making an erosion control mat using loop matting.

Another embodiment of the disclosed system, generally designated 100, is shown in FIG. 7. In that embodiment, a frame 112 supports a coil 172 of the sheet 900, which in embodiments the coil is mounted on a rotatable spindle 174 adjacent the drum 16. In embodiments, the spindle is rotatably attached at its ends to the frame 112 and is positioned on the frame such that the sheet 900 pays off of the top of the coil 172 and extends downwardly to contact and cover the outer surface 22 of the drum 16 beginning at or above the 9 o'clock position 178 and extending down to the 6 o'clock position 182.

In this embodiment of the system 100, as with the embodiment of the system 10 shown in FIG. 1, the sheet 900 is held against the outer surface 22 of the drum 16 by the tension resulting from the resistance of the spindle 174 to rotation in the direction of arrow B and pinching the sheet of loop matting between the outer surface 22 of the drum 16 and the support surface 84 at the 6 o'clock position 182. Accordingly, in embodiments, the spindles 72 (FIG. 1), 174 include friction bearings that resist rotation sufficiently to prevent overrunning of the coils 74 (FIG. 1), 172 and to provide tension on the sheet 900 against the outer surface 22 of the drum 16 to retain the hardenable paste 30 in the mold cavities 20.

Optionally, the embodiment 100 shown in FIG. 7 includes a shield 102 that is attached to the frame at its lateral ends by arms 104 mounted on the frame 112 (only one arm 104 is shown, the other arm being identical thereto). the shield 102 is arcuate in shape and is curved to conform to the curvature of the outer surface 22 of the drum 16. In embodiments, the shield 102 is fixed relative to the drum 16, or optionally adjustable in radial orientation relative to the drum, for example by pivoting the arms 104 relative to the frame 112, and positioned adjacent a segment of the outer surface 22 of the drum. In embodiments, the shield 102 is positioned downstream of the hopper 28. The shield 102 is spaced from the outer surface 22 sufficiently to retain the paste 30, which has been deposited in the molds 20 from the hopper 28, within the molds. In embodiments, the shield 102 is made of a rigid material, such as galvanized steel, aluminum alloy, an abrasion-resistant polymer, or a combination of the foregoing. In other embodiments, the shield 102 is made of a light-duty netting to retain the hardenable paste 30 within the mold cavities 20. With this embodiment, the sheet 900 is fed from the coil 172 on the spindle 174 to cover the mold cavities 20 and the cylindrical outer surface 22 below the shield 102. In embodiments, the sheet 900 is fed from the coil 172 to cover the mold cavities 20 and cylindrical outer surface 22 below the 9 o'clock position on the drum 16.

Figure 5:
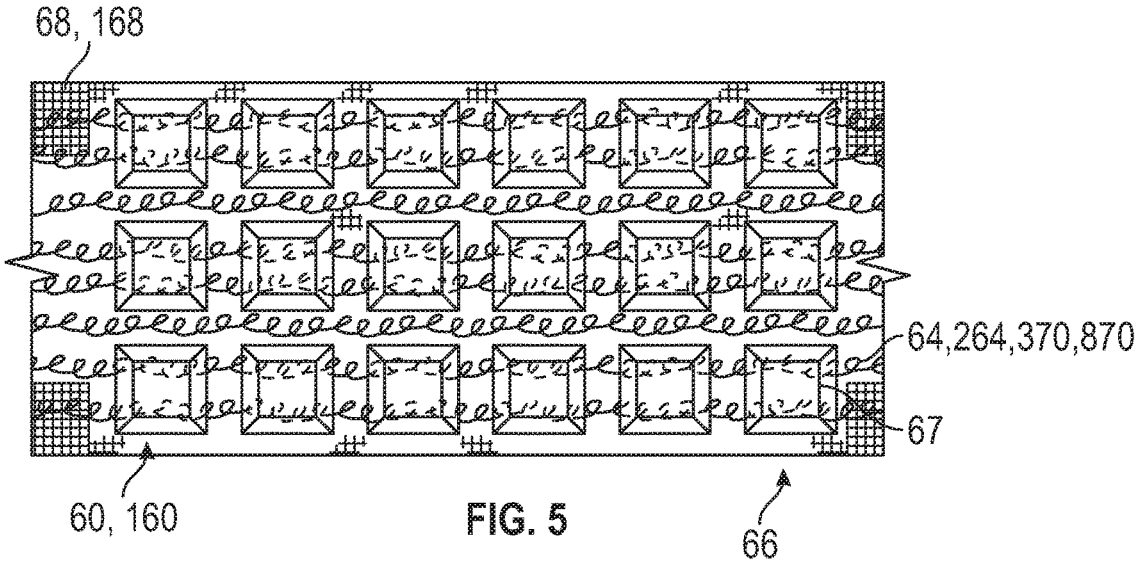
FIG. 5 is a schematic top plan view of the erosion control mat made by the disclosed process and system.
Figure 6:
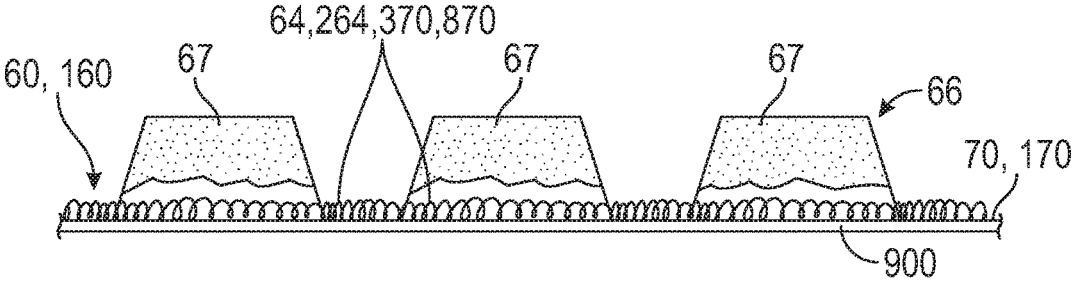
FIG. 6 is a schematic, side elevation of the erosion control mat of FIG. 5 in which the blocks are broken away to reveal the embedded loops of the loop matting of FIGS. 2A and 2B.

An exemplary embodiment of the process for making the erosion control mat 66 shown in FIGS. 1, 5, and 6 is as follows. The cylindrical drum 16 having a plurality of mold cavities 20 about an outer surface 22 thereof is rotated in the direction of arrow C. In the embodiments of FIGS. 1 and 7, this rotation is effected by displacing the frame 12, 112 on which the drum 16 is rotatably mounted relative to the support surface 84 on which the drum contacts and is supported by, which is the direction of arrow A in FIGS. 1 and 7. The displacement of the frame 12, 112 is effected by pulling it by the vehicle 14 to which it is attached. In other embodiments, the frame 12, 112 itself is motorized and self-propelled, thus eliminating the need for vehicle 14.

Next, the hardenable paste 30 is deposited into the mold cavities 20. In embodiments, the hardenable paste 30 is deposited from the concrete transport truck 34 and flows through the chute 32 into the hopper 28, where it is distributed evenly along the width of the hopper by the mixing impeller 50, which is rotated by motor 52. The hardenable paste 30 flows downwardly through the holes 48 of the opening 46 and into the mold cavities 20 to fill the mold cavities as the rotation of the drum 16 relative to the hopper 28 causes the mold cavities to pass adjacent and align with the holes. In some embodiments, the holes 48 are positioned above the mold cavities 20. In an embodiment in which the mold cavities 20 are arranged in rows on the drum 16, rotation of the drum brings successive rows of mold cavities into alignment with the holes 48. In embodiments, the hopper 28 and holes 48 are located at the vertical or 12 o'clock position 86 relative to the circular end 80 of the cylindrical drum 16; in other embodiments, the hopper and holes are located upstream or downstream of the 12 o'clock position. Continued movement of the frame 12, 112 relative to the support surface 84 causes the drum 16 to continue to rotate, thereby moving the mold cavities 20, now filled with hardenable but unsolidified paste, in a counterclockwise direction in FIGS. 1 and 7.

If left uncovered, the hardenable paste 30, although somewhat viscous, would partially or completely flow out of the mold cavities 20 and over the outer surface 22 of the drum 16 as the mold cavities rotate from the 12 o'clock position 86 down to the 6 o'clock position 82, 182. Thus, the outer surface 22 of the cylindrical drum 12 and outer surfaces 62 of the hardenable paste in the mold cavities 20 are covered with the sheet 900 such that the mesh material retains the hardenable paste within the mold cavities. At the same time, the three-dimensional mat of the sheet 900 projects into and embeds in the hardenable paste 30 in the mold cavities 20.

As the drum 16 continues to rotate, the speed of rotation, which results from movement of the frame 12, 112, and hence the residence time of the hardenable paste 30 in the mold cavities 20 covered by the sheet 900, is selected, along with selecting the cure rate of the hardenable paste, to allow the hardenable paste to harden in the mold cavities and securely attach to the loops 64, thereby forming the erosion control mat 66, which includes blocks 67 of hardened paste attached to the sheet 900 by the three-dimensional mat. In an embodiment, the cure rate of the hardenable paste 30 is selected to allow the paste to flow from the chute 32 in the hopper 28, be distributed along the length of the hopper, flow through the slots 48 and into the mold cavities 20 at the 12 o'clock position 86, and receive and become embedded by the three-dimensional mat component of the sheet 900. Further, the paste 30 is cured or substantially cured or solidified into dimensionally stable blocks 67 by the time the drum 16 rotates so that the blocks 67, which are connected to the three-dimensional mat component of the sheet 900, drop from the molds 20 at the 6 o'clock position 82, 182.

An advantage of this process, in which the hardenable paste 30 hardens in the mold cavities 20 to form the blocks 67 of hardened paste connected to the sheet 900 by the mat, is that the paste hardening process occurs continuously, while the cylindrical drum 16 continues to rotate in response to movement of the frame 12, 112. Also in an embodiment of the process, the blocks 67 of hardened paste are arranged spaced from each other in an array on the sheet 900, as shown in FIG. 5. The spacing is determined by the spacing of the mold cavities 20 on the drum 16, and may be selected to allow vegetation to grow upwardly through the mat 160 (FIG. 2B).

In an exemplary embodiment, release of the cast blocks 67 of hardened paste downwardly from the molds 20 is continuous during rotation of the drum 16 and is effected by gravity. Continuing to rotate the drum 16 allows the blocks 67 of hardened paste to fall from the rows 18 of mold cavities 20 onto the support surface 84, thereby forming the erosion control mat 66 wherein the sheet 900 is a lowermost layer beneath and attached to a plurality of the blocks of hardened paste. In a particular embodiment, the blocks 67 of hardened paste fall from the rows 18 of mold cavities 20 at the 6 o'clock position 82, 182 relative to a circular end 80 of the cylindrical drum 16.

In embodiments of the system 10, the sheet 900 is payed out from the roll 74 and is passed over the idler roll 76 adjacent the cylindrical drum 16 and downwardly from the idler roll against the outer surface 22 of the cylindrical drum and the outer surfaces 62 of the hardenable paste 30 in the molds 20. Passing the sheet 900 over the idler roll 76 includes positioning the idler roll relative to the cylindrical drum 16 such that the sheet 900 contacts the cylindrical drum at or above the 9 o'clock position 78 relative to the circular end 80 of the cylindrical drum 16.

In embodiments, covering the outer surface 22 of the cylindrical drum 16 and the outer surfaces 62 of the hardenable paste 30 in the molds 20 includes bringing the sheet 900 into contact with the outer surface of the cylindrical drum and the outer surfaces of the hardenable paste. The three-dimensional mat projects upwardly from the surface of the base. Also in embodiments of the disclosed process, covering the outer surface 22 of the cylindrical drum 16 and the outer surfaces 62 of the hardenable paste 30 includes bringing the sheet 900, which is made of a weather-resistant material, in particular polypropylene, into contact with the outer surface and hardenable paste 30.

In the embodiment of the system 100 shown in FIG. 7, the disclosed process includes positioning the spindle 172 that supports the roll 174 of the coiled sheet 900 on the frame 112 adjacent the drum 16. In embodiments, the roll 174 is positioned such that the sheet 900 is payed out from the roll downwardly to begin to contact and cover the outer surface 22 of the drum 16 and the outer surfaces 62 of the hardenable paste 30 in the mold cavities 20 at or above the 9 o'clock position 178 on the end 80 of the drum, and continuously contact and cover the outer surface of the drum and the outer surfaces of the hardenable paste until the outer surface of the drum and the mold cavities 20 reach the 6 o'clock position 182, at which time the hardenable paste 30 has hardened into the blocks 67 attached to the sheet 900. In an embodiment in which the mold cavities are arranged on the outer surface 22 of the drum 16 in successive rows 18 of the mold cavities 20, the hardenable paste 30 is retained within the successive rows of the mold cavities by the sheet 900.

In sum, with the embodiments 10, 100 depicted in both FIG. 1 and FIG. 7, the process for making an erosion control mat includes rotating the cylindrical drum 16 supported on a support surface 84 by displacing the frame 12, 112 on which the cylindrical drum is rotatably mounted relative to the support surface. The hardenable paste 30 is deposited into the hopper 28 above the cylindrical drum 16 such that the hardenable paste flows downwardly through the opening 48 in the hopper into the mold cavities 20 formed in an outer surface 22 of the cylindrical drum 16 as the mold cavities align with the opening. The continuous sheet 900 is payed out from the spindle 72, 172 on the downstream side of the hopper 28 to cover the outer surface 22 of the cylindrical drum 16 and the outer surfaces 62 of the hardenable paste 30 deposited in the mold cavities 20, such that the sheet retains the hardenable paste within the mold cavities, and the three-dimensional component of the sheet projects into and embed in the hardenable paste in the mold cavities.

The sheet 900 is held against the outer surface 22 of the cylindrical drum 16 by tension of the sheet from resistance of the spindle 72, 172 to rotation and a pinch of the sheet between the cylindrical drum and the support surface 84, which in embodiments is at, or is approximately at, the 6 o'clock position 82, 182. The frame 12, 112 continues to be displaced by the vehicle 14 relative to the support surface 84 at a rate sufficient to rotate the cylinder 16 at a speed that enables the hardenable paste 30 to harden or solidify or cure into the blocks 67 in the mold cavities 20 and attach to the three-dimensional component, thereby forming the erosion control mat 66 having blocks 67 of hardened paste attached to the sheet 900. The sheet 900 is selected, as described in the embodiments of FIGS. 2A-2N, to be sufficiently strong to hold the blocks 67 without need of additional connecting elements, such as a separate geogrid. Further, the sheet 900 is selected to perform the dual function of interconnecting the blocks 67 into the mat 66 and retaining the hardenable paste 30 in the molds 20 during the curing process.

Figure 8:
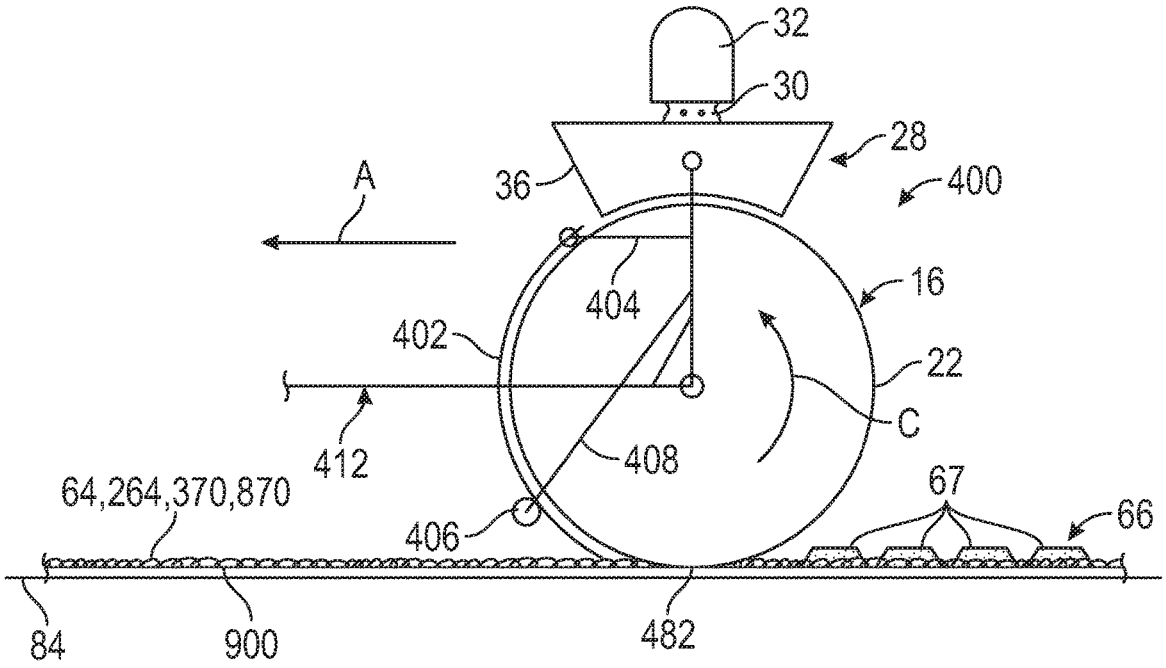
FIG. 8 is a schematic, side elevational view of yet another embodiment of the disclosed system for making an erosion control mat using three-dimensional matting.

In the embodiment of the system, generally designated 400, shown in FIG. 8, the drum 16 is rotatably attached to a frame 412 that includes an rigid shield 402 that is arcuate in shape and curved to conform to, and extend the entire width of, the outer surface 22 of the drum 16. In embodiments, the shield 402 is made of a rigid material, such as galvanized steel, aluminum alloy, an abrasion-resistant polymer, or a composite of a polymer and steel and/or aluminum. The shield 402 is pivotally attached to beams 404 (only one beam 404 being shown, the other beam being identical thereto) at lateral ends at its upper end adjacent the hopper 28, and is held against the outer surface 22 at its lower end by a transverse tube or bar 406 attached at its ends to pivot arms 408 (only one pivot arm 408 being shown, the other pivot arm being identical thereto) pivotally attached to a remainder of the frame 412. Thus, the weight of the shield 402 itself urges the shield against the drum 16.

In embodiments, the pivot arm 408 may take the form of a chain. In embodiments, the attachments at 404 and 406 hold the shield 402 against the outer surface 22 of the drum 16 from a position adjacent a downstream side of the wall 36 of hopper 28 downwardly to a position adjacent the upstream side of the six o'clock or bottom position 482. In other embodiments, the shield 402 extends from a position adjacent the 10 o'clock or 9 o'clock positions, or any position in between the downstream side of the hopper 28 and the 6 o'clock position.

The sheet of three-dimensional matting 900 is in the form of an elongate sheet of mesh material that is placed upon the support surface 84 such that the filaments 64, 264, 370, 870 are exposed to and/or project upwardly toward the drum 16. The drum 16 is rotated in the direction of arrow C directly over the sheet of three-dimensional matting 900, in embodiments by lateral displacement of the frame 412 relative to the support surface 84 and the sheet of three-dimensional matting in the direction of arrow A, which may be effected by vehicle 14 (FIG. 1), or by a self-propelled frame 412. The flowable, hardenable paste 30 is deposited into the hopper 28 from chute 32, and is deposited into the molds 20 (FIGS. 3 and 4) from the hopper 28. The hardenable paste 30 is retained in the molds 20 by the force of the shield 402 against the outer surface 22 of the drum beneath it as the drum 16 rotates the molds from beneath the hopper 28 in the direction of arrow C.

The rotation of the drum 16 progresses the molds 20 downwardly from the hopper 28 beneath the shield 402 to the six o'clock or bottom position 482. At the bottom position 482, the hardenable paste 30 within the molds 20, which is not yet completely solidified, contacts and is embedded by the sheet of three-dimensional matting 900 by the compressive downward force of the drum 16 over the bottom position against the sheet of three-dimensional matting and the support surface 84 beneath it. As the drum 16 continues to roll in the direction of arrow C, the hardenable paste 30, now attached to the filaments 64, 264, 370, 870 at the bottom position 482, releases from the molds 20 in the form of blocks 67. The blocks 67 become dimensionally stable at, or shortly after, the time of release from the molds 20 at the bottom position 482 and thereafter solidify with the filaments 64, 264, 370, 870 embedded in them, which attaches the blocks to the sheet of three-dimensional matting 900. The blocks 67, together with the sheet of three-dimensional matting 900, form the erosion control mat 66.

Figure 9:
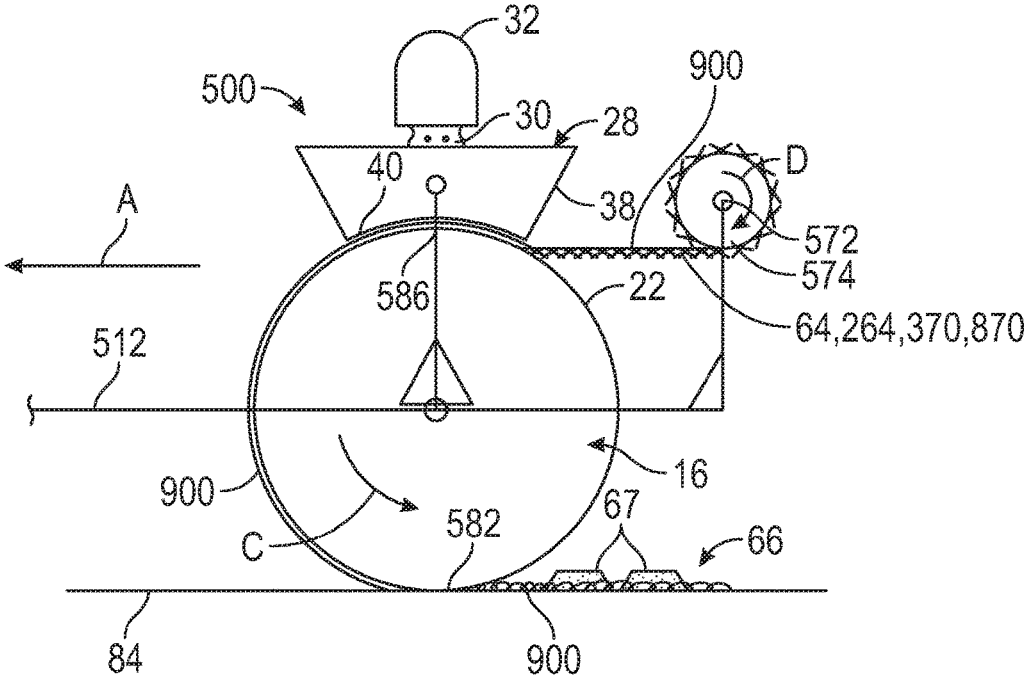
FIG. 9 is a schematic, side elevational view of still another embodiment of the disclosed system for making an erosion control mat using three-dimensional matting.

As shown in FIG. 9, in still another embodiment of the system, generally designated 500, the sheet of three-dimensional matting 900 is in the form of a coil 574 rotatably supported on a spindle 572 that is mounted on the frame 512. The frame 512 rotatably supports the drum 16 and hopper 28 at the top or twelve o'clock position 586, and supports the spindle 572 upstream of the hopper 28; that is, to the rear of the hopper 28 as the frame 512 moves in the direction of arrow A over support surface 84.

The spindle 572 is spatially oriented relative to the drum 16 and hopper 28 so that the sheet of three-dimensional matting 900 pays out from the coil 574, which may be from the bottom of the coil as shown in FIG. 9, or from the top of the coil, such that the filaments 64, 264, 370, 870 face downwardly toward the molds 20 (FIGS. 3 and 4) in the drum 16. The sheet of three-dimensional matting 900 extends to and engages the drum 16 between the outer surface 22 and the bottom wall 40 of the hopper 28, entering at the rear wall 38. From the rear wall 38 the sheet of three-dimensional matting 900, extends beneath the hopper 28, where the hardenable paste 30 from the chute 32 is deposited into the molds 20.

The openings in the sheet of three-dimensional matting 900 are sufficiently large to allow the hardenable paste 30 to flow therethrough from the hopper 28 downwardly into the molds 20, but sufficiently small to prevent the hardenable paste from flowing out of the molds as the molds progress downwardly from the top position 586 to the bottom or six o'clock position 582, because the paste becomes more viscous as it hardens and therefore resists flowing out of the molds. At the top position 586, the filaments 64, 264, 370, 870 embed in the hardenable paste 30 in the molds 20 as the molds fill with the hardenable paste and the sheet of three-dimensional matting 900 is held against the outer surface 22 of the drum 16.

This arrangement, in which the sheet of three-dimensional matting 900 is held against the outer surface 22 of the drum 16, is maintained because of the tension exerted on the sheet of three-dimensional matting between the pinch of the drum against the sheet of three-dimensional matting at the bottom position 582 and the resistance of the spindle 572 to rotation of the coil 574 at the upstream end of the sheet of three-dimensional matting. At the bottom position 582, the hardenable paste 30 in the molds 20 has hardened sufficiently to adhere to the filaments 64, 264, 364 so that the blocks 67 fall from the molds 20, forming the mat 66.

With each of the embodiments of systems 100, 200, 500 described herein, an elongate sheet of three-dimensional matting 900 is utilized to serve a dual purpose. First the sheet of three-dimensional matting 900 forms an integral part of the erosion control mat 66, comprised of the sheet of three-dimensional matting in which blocks 67 of hardened paste 30 are cast and held in a predetermined array. Second, and this benefit exists also with the embodiment of system 400, the sheet of three-dimensional matting 900 is used to retain the hardenable paste 30 in the molds 20 of the drum 16 during the process that forms the molded blocks 67. As the sheet of three-dimensional matting 900 retains the hardenable paste in the molds 20 while the drum 16 rotates, the sheet of three-dimensional matting contacts the outer surfaces 62 of the hardenable paste 30 so that the filaments 64, 264, 370, 870 embed in the hardenable paste, thereby permanently attaching the blocks 67 to the sheet of three-dimensional matting to form the erosion control mat 66.

In general, the process for making an erosion control mat 10, 100 includes first depositing a hardenable paste 30 in flowable form into a plurality of molds 20, which may be formed in the outer surface 22 of the drum 16. The molds 20 are covered with a sheet 900 of a geocomposite 260, 360, 860 having a multiplicity of protrusions, which may take the form of filaments 64, 264, 370, 870, projecting outwardly therefrom, so that the multiplicity of protrusions extends into the hardenable paste 30 in the plurality of molds. The geocomposite 260, 360, 860 having a multiplicity of protrusions 64, 870 is held against the molds 20 until the paste 30 therein hardens sufficiently to form blocks 67 within the molds attached to the geocomposite 260, 360, 860 by the multiplicity of protrusions. The sufficiently hardened blocks 67 are removed from the molds 20 to form the erosion control mat 10, 100 having the sufficiently hardened blocks interconnected by the geocomposite 260, 360, 860.

In embodiments, depositing the hardenable paste 30 includes depositing a hardenable paste in flowable form downwardly into a plurality of molds 20 opening upwardly. Further, removing the solid blocks 67 from the molds in embodiments includes inverting the molds 20 so that the sufficiently hardened blocks, interconnected by the geotextile 260, 360, fall out of the molds. In exemplary embodiments, the geotextile is selected from a loop matting 260 and a woven textile having synthetic turf 870.

While the methods and forms of apparatus disclosed herein constitute preferred forms of the disclosed process and system for making an erosion control mat using loop matting, it is to be understood that the system and invention are not limited to these precise forms of apparatus and methods, and that changes may be made therein without departing from the scope of the disclosure.

What is claimed is:

1. A process for making an erosion control mat having a plurality of blocks of hardened paste attached to and joined together by a sheet of mesh material, the process comprising:

rotating a cylindrical drum having a plurality of mold cavities about an outer surface thereof shaped to form the blocks;

depositing a flowable, hardenable paste into the mold cavities;

selecting the sheet of mesh material to have sufficient tensile strength to join the blocks of hardened paste together without tearing or separating from the blocks of hardened paste and to have sufficient density to retain the paste within the mold cavities as the drum rotates and further having a geotextile base with filaments projecting upwardly from the base;

covering an outer surface of the cylindrical drum and outer surfaces of the flowable paste in the mold cavities with the sheet of mesh material as the cylindrical drum rotates such that the filaments are oriented to extend into the mold cavities and embed in the hardenable paste;

continuing to rotate the cylindrical drum as the flowable, hardenable paste hardens into dimensionally stable blocks in the mold cavities, and holding the sheet of mesh material against the outer surface such that the sheet of mesh material retains the paste within the mold cavities; and separating the dimensionally stable blocks from the mold cavities, thereby forming the erosion control mat of the sheet of mesh material with the filaments embedded in the blocks sufficiently to connect the sheet of mesh material to the blocks and the blocks to each other.

2. The process of claim 1, wherein covering an outer surface of the cylindrical drum and outer surfaces of the paste in the mold cavities with the sheet includes covering the outer surface of the cylindrical drum and outer surfaces of the hardenable paste in the mold cavities with a sheet of flexible geosynthetic mesh material.

3. The process of claim 2, wherein the flexible geosynthetic mesh material is selected from loop matting, a three-dimensional mat, and combinations thereof.

4. The process of claim 1, wherein separating the blocks from the mold cavities includes separating the blocks from the mold cavities while the cylindrical drum continues to rotate.

5. The process of claim 1, wherein separating the blocks from the mold cavities includes continuing to rotate the drum to allow the blocks of hardened paste to fall from the mold cavities onto a support surface, thereby forming the erosion control mat wherein the sheet of mesh material is a lowermost, continuous layer beneath and embedded into the plurality of the blocks of hardened paste.

6. The process of claim 1, wherein rotating the cylindrical drum includes rotating the cylindrical drum beneath a hopper; and depositing the flowable, hardenable paste into the mold cavities includes depositing the paste into the hopper such that the paste flows from the hopper through an opening in the hopper into the successive rows of the mold cavities as the cylindrical drum rotates.

7. The process of claim 6, wherein depositing the hardenable paste into the hopper through the opening includes depositing the hardenable paste into the hopper such that the paste flows along the hopper and through a plurality of slots comprising the opening, each of the plurality of slots having a location and width that corresponds to a location and width of outer openings of the mold cavities that pass adjacent thereto as the drum rotates.

8. The process of claim 7, wherein covering the outer surface of the cylindrical drum and the outer surfaces of the paste in the mold cavities includes covering the outer surface of the cylindrical drum and the outer surfaces of the hardenable paste in the mold cavities with the sheet of mesh material downstream of the hopper.

9. The process of claim 8, wherein rotating the cylindrical drum includes rotating the cylindrical drum having a plurality of mold cavities beneath the hopper located at a vertical or 12 o'clock position relative to the cylindrical drum.

10. The process of claim 9, wherein rotating the cylindrical drum includes moving a frame on which the cylindrical drum is rotatably mounted relative to a fixed a surface supporting the drum, thereby causing the drum to rotate over the fixed surface; and covering the outer surface of the drum and the outer surfaces of the hardenable paste in the mold cavities with the sheet includes paying out the sheet from a roll of coiled sheet rotatably mounted on the frame.

11. The process of claim 10, wherein paying out the flexible sheet from the roll includes passing the sheet over an idler roll adjacent the cylindrical drum and downwardly from the idler roll against the outer surface of the cylindrical drum and the outer surfaces of the paste in the molds.

12. The process of claim 11, wherein passing the sheet over the idler roll includes positioning the idler roll relative to the cylindrical drum such that the sheet contacts the cylindrical drum at or above a 9 o'clock position relative to the circular end of the cylindrical drum.

13. A process for making an erosion control mat having a plurality of blocks of hardened paste attached to and joined together by a sheet of mesh material, the process comprising:

rotating a cylindrical drum having a plurality of mold cavities about an outer surface thereof shaped to form the blocks;

depositing a flowable, hardenable paste into the mold cavities;

selecting the sheet of mesh material to have sufficient tensile strength to join the blocks of hardened paste together without tearing or separating from the blocks of hardened paste, and to have sufficient density to retain the paste within the mold cavities as the drum rotates;

covering an outer surface of the cylindrical drum and outer surfaces of the flowable paste in the mold cavities with the sheet of mesh material as the cylindrical drum rotates;

continuing to rotate the cylindrical drum as the flowable, hardenable paste hardens into dimensionally stable blocks in the mold cavities and holding the sheet of mesh material against the outer surface such that the sheet of mesh material retains the paste within the mold cavities and at least a portion of the sheet of mesh material becomes embedded in the paste;

separating the dimensionally stable blocks from the mold cavities, thereby forming the erosion control mat consisting of the sheet of mesh material embedded in the blocks sufficiently to connect the blocks to each other;

wherein the sheet includes loop matting having loops woven into a layer of woven mesh fabric that project upwardly from a surface of the layer of woven mesh fabric; and wherein covering the outer surface of the cylindrical drum and the outer surfaces of the paste includes bringing the loop matting into contact with the outer surface of the cylindrical drum and the outer surfaces of the paste such that the loops project into the mold cavities and embed in the paste therein.

14. The process of claim 13, wherein covering an outer surface of the cylindrical drum and outer surfaces of the paste includes bringing the sheet of loop matting into contact with the outer surface of the cylindrical drum and the outer surfaces of the paste.

15. The process of claim 14, wherein covering the outer surface of the cylindrical drum and the outer surfaces of the paste includes retaining the paste within the mold cavities by the layer of woven mesh fabric as the cylindrical drum rotates, wherein the woven mesh fabric is selected from an open mesh and a tightly woven impermeable mesh material.

16. A process for making an erosion control mat having a plurality of blocks of hardened paste attached to and joined together by a sheet of mesh material, the process comprising:

rotating a cylindrical drum on a support surface by displacing a frame on which the cylindrical drum is rotatably mounted relative to the support surface;

depositing a flowable, hardenable paste into a hopper adjacent the cylindrical drum such that the hardenable paste flows through an opening in the hopper into mold cavities formed in an outer surface of the cylindrical drum as the mold cavities move into alignment with the opening;

paying out a continuous sheet of mesh material from a spindle on a downstream side of the hopper to cover the outer surface of the cylindrical drum and outer surfaces of the paste deposited in the mold cavities such that the sheet retains the paste within the mold cavities, wherein the sheet of mesh material includes filaments that project upwardly from the sheet of mesh material into the mold cavities and embed in the paste in the mold cavities;

holding the sheet of mesh material against the outer surface of the cylindrical drum by tension of the sheet of mesh material from resistance of the spindle to rotation and a pinch of the sheet between the cylindrical drum and the support surface; and continuing to displace the frame relative to the support surface at a rate sufficient to rotate the cylinder at a speed that enables the paste to harden into solid blocks in the mold cavities and to embed the filaments in the blocks, thereby forming the erosion control mat of the sheet of flexible, mesh material with the filaments embedded in the blocks sufficiently to join the blocks to the sheet of flexible, mesh material in a continuous mat.

17. The process of claim 16, further comprising covering the outer surface of the drum and the mold cavities with a shield positioned downstream of the hopper and upstream of the sheet, whereby the shield and sheet retain the paste within the mold cavities.

18. A system for making an erosion control mat, the system comprising:

a movable frame;

a cylindrical drum having a plurality of mold cavities about a periphery thereof, the cylindrical drum rotatably mounted on the frame;

a hopper positioned transversely of the cylindrical drum for receiving and distributing a flowable, hardenable paste into the mold cavities;

a sheet having flexible, three-dimensional material having filaments that project upwardly therefrom, the three-dimensional material supported on the frame and fed to cover an outer surface of the cylindrical drum and outer surfaces of the paste in the mold cavities such that the flexible sheet contacts the paste and retains the paste within the mold cavities and the filaments project into the mold cavities and embed in the paste in the mold cavities, so that the paste solidifies into dimensionally stable blocks in the mold cavities to form the erosion control mat having blocks of hardened paste attached to the flexible sheet by the filaments.

19. The system of claim 18, further comprising a spindle rotatably mounted on the frame and containing a coil of the sheet.

20. The system of claim 19, further comprising an idler roller rotatably mounted on the frame between the spindle and the cylindrical drum, wherein the flexible sheet passes over the idler roller and downwardly from the idler roller to cover the outer surface of the cylindrical drum and outer surfaces of the paste within the mold cavities.

21. The system of claim 18, wherein the flexible sheet is made of a geosynthetic loop matting wherein the filaments take the form of loops woven into a layer of woven mesh.

22. The system of claim 18, further comprising a shield positioned downstream of the hopper and upstream of the sheet covering the outer surface of the drum and mold cavities;

the shield and sheet retaining the paste within the mold cavities.

23. A process for making an erosion control mat having dimensionally stable blocks of hardened paste interconnected by a sheet having a multiplicity of protrusions projecting upwardly therefrom, the process comprising:

depositing a hardenable paste in flowable form into a plurality of molds;

covering the molds with the sheet having the multiplicity of protrusions projecting upwardly therefrom, the sheet oriented so that the multiplicity of protrusions extends into the plurality of molds and embeds in the hardenable paste;

holding the sheet against the molds until the hardenable paste hardens sufficiently within the molds to form dimensionally stable blocks attached to the sheet by the multiplicity of protrusions embedded in the plurality of the dimensionally stable blocks; and removing the dimensionally stable blocks from the molds to form the erosion control mat consisting of the dimensionally stable blocks interconnected by the sheet.

24. The process of claim 23, wherein depositing the hardenable paste includes depositing the hardenable paste in flowable form downwardly into molds opening upwardly of the plurality of molds.

25. The process of claim 23, wherein removing the dimensionally stable blocks from the molds includes inverting the molds so that the dimensionally stable blocks, interconnected by the sheet, fall out of the molds.

26. The process of claim 23, wherein the sheet is a geocomposite selected from a loop matting and a woven textile having synthetic turf.

27. A process for making an erosion control mat having dimensionally stable blocks of hardened paste interconnected by a sheet of flexible mesh material in the form of a nonwoven geotextile having a multiplicity of protrusions projecting upwardly therefrom, the process comprising:

depositing a hardenable paste in flowable form into a plurality of mold cavities;

covering the mold cavities with the sheet having the multiplicity of protrusions projecting upwardly therefrom, the sheet oriented so that the multiplicity of protrusions extends into the plurality of mold cavities and embeds in the paste in the plurality of mold cavities;

holding the sheet against the mold cavities until the paste hardens sufficiently within the mold cavities to form dimensionally stable blocks attached to the sheet by the multiplicity of protrusions embedded in the plurality of the dimensionally stable blocks; and removing the dimensionally stable blocks from the mold cavities to form the erosion control mat consisting of the dimensionally stable blocks interconnected by the sheet.

* * * * *